US006945414B1

(12) United States Patent
Stevens et al.

(10) Patent No.: US 6,945,414 B1
(45) Date of Patent: Sep. 20, 2005

(54) WALL PANEL AND SYSTEM

(75) Inventors: Kenneth V. Stevens, Brooklyn, NY (US); Constantine A. Valaoritis, New York, NY (US); Keith E. Gilman, Scotch Plains, NJ (US)

(73) Assignee: Products of Tomorrow, Inc., Towaco, NJ (US)

( * ) Notice: Subject to any disclaimer, the term of this patent is extended or adjusted under 35 U.S.C. 154(b) by 0 days.

(21) Appl. No.: 10/338,147

(22) Filed: Jan. 8, 2003

Related U.S. Application Data

(60) Provisional application No. 60/419,741, filed on Oct. 18, 2002.

(51) Int. Cl.[7] ..... A47F 5/08
(52) U.S. Cl. ..... 211/94.01; 211/183; 248/220.31
(58) Field of Search ..... 211/94.01, 94.02, 211/192, 183, 86.01; D25/123, 125; 248/222.41, 248/223.21, 220.31, 223.41, 224.51, 224.61

(56) References Cited

U.S. PATENT DOCUMENTS

| | | | | |
|---|---|---|---|---|
| 2,029,089 | A * | 1/1936 | Weirauch | 248/223.21 |
| 3,192,667 | A | 7/1965 | Bauer | |
| 3,204,776 | A * | 9/1965 | Brown et al. | 211/70.6 |
| 3,310,271 | A * | 3/1967 | King | 248/220.43 |
| 3,469,710 | A * | 9/1969 | Vosbikian | 211/116 |
| 3,698,565 | A | 10/1972 | Weber | |
| 3,733,756 | A | 5/1973 | Butler | |
| 4,223,488 | A | 9/1980 | Schoenung | |
| 4,229,913 | A | 10/1980 | Corrigan | |
| 4,323,163 | A | 4/1982 | Johns | |
| 4,420,087 | A | 12/1983 | Johns | |
| 4,438,604 | A | 3/1984 | McGourty, Jr. et al. | |
| 4,450,970 | A | 5/1984 | Shepherd | |
| 4,572,381 | A | 2/1986 | Breakey et al. | |
| 4,579,308 | A | 4/1986 | Jensen | |
| 4,589,557 | A | 5/1986 | Bollmann | |
| 4,591,058 | A | 5/1986 | Amstutz et al. | |
| 4,593,824 | A * | 6/1986 | Pfeifer | 211/57.1 |
| 4,598,504 | A | 7/1986 | Itagaki | |
| 4,602,756 | A * | 7/1986 | Chatfield | 248/223.41 |
| 4,607,753 | A | 8/1986 | Radek | |
| 4,615,448 | A | 10/1986 | Johnstonbaugh | |
| 4,629,076 | A | 12/1986 | Amstutz et al. | |
| 4,638,618 | A | 1/1987 | Iesaka et al. | |
| 4,674,240 | A | 6/1987 | Strausheim | |
| 4,677,794 | A | 7/1987 | Parron et al. | |
| 4,805,783 | A | 2/1989 | Mayer | |
| 4,805,784 | A * | 2/1989 | Solheim et al. | 211/94.01 |
| 4,809,479 | A | 3/1989 | Tierno et al. | |
| 4,811,475 | A | 3/1989 | Morton, Jr. | |
| 4,825,601 | A | 5/1989 | Halverson | |
| 4,826,022 | A * | 5/1989 | Duarte | 211/59.1 |

(Continued)

FOREIGN PATENT DOCUMENTS

| | | | | |
|---|---|---|---|---|
| GB | 2026850 | * | 7/1979 | 211/59.2 |

*Primary Examiner*—Jennifer E. Novosad
(74) *Attorney, Agent, or Firm*—Lerner, David, Littenberg, Krumholz & Mentlik, LLP

(57) ABSTRACT

A wall panel for holding an accessory, the wall panel having a recessed slot, at least a portion of which has an undercut and a shaped opening in communication with a portion of the recessed slot and the undercut. The shaped opening may be capable of receiving a shaped attachment member of an accessory, the shaped attachment member then being slidable within the undercut and the recessed slot beyond the limits of the shaped opening. A plurality of wall panels may be adapted to form a wall panel system.

21 Claims, 27 Drawing Sheets

U.S. PATENT DOCUMENTS 4,891,897 A 1/1990 Gieske et al.
4,932,538 A 6/1990 Gambello
4,944,416 A 7/1990 Petersen et al.
4,961,295 A * 10/1990 Kosch, Sr. et al. ..... 211/94.02
5,138,803 A 8/1992 Grossen
5,142,832 A 9/1992 Branham, Sr. et al.
5,185,971 A 2/1993 Johnson, Jr.
5,228,579 A 7/1993 Kaufman
5,241,796 A 9/1993 Hellwig et al.
5,337,525 A 8/1994 Zaccai et al.
5,360,121 A 11/1994 Sothman
5,375,802 A 12/1994 Branham, II
5,412,912 A 5/1995 Alves
5,429,252 A * 7/1995 Liu ..... 211/94.01
5,477,969 A 12/1995 Beeskau et al.
5,484,067 A 1/1996 Sothman
5,547,156 A * 8/1996 Djuric ..... 248/307
5,582,376 A 12/1996 Thompson
5,655,674 A 8/1997 Holztrager
5,671,852 A 9/1997 Maharg
5,697,507 A * 12/1997 Blass ..... 211/94.01
5,740,927 A * 4/1998 Yemini ..... 211/70.6
5,791,093 A 8/1998 Diamond
5,819,490 A 10/1998 Current
5,857,577 A 1/1999 Thomas et al.
5,899,344 A 5/1999 Current et al.
5,941,026 A 8/1999 Eisenreich et al.
5,944,203 A 8/1999 Vlah et al.
6,050,426 A 4/2000 Leurdijk
6,068,135 A 5/2000 Holztrager
6,116,435 A 9/2000 Young
6,119,784 A 9/2000 MacDonald, III et al.
6,119,878 A 9/2000 Zen
6,123,154 A 9/2000 MacDonald, III et al.
6,134,846 A 10/2000 Lamb
6,164,467 A 12/2000 DePottey et al.
6,199,705 B1 3/2001 Portner
6,209,730 B1 4/2001 Ewing
6,276,034 B1 8/2001 Bachman et al.
6,299,001 B1 10/2001 Frolov et al.
6,311,854 B1 11/2001 Anderson
6,325,223 B1 12/2001 Hannen
6,349,507 B1 2/2002 Muellerleile
6,363,645 B1 4/2002 Hunter
6,591,996 B1 * 7/2003 Wu ..... 211/90.02
2001/0047971 A1 * 12/2001 Chance et al. ..... 211/87.01
2003/0189019 A1 * 10/2003 Campbell et al. ..... 211/94.01

* cited by examiner

WALL PANEL AND SYSTEM

CROSS-REFERENCE TO RELATED APPLICATIONS

This application claims the benefit of U.S. provisional application No. 60/419,741, filed Oct. 18, 2002 and expressly incorporates the disclosure of same by reference.

BACKGROUND OF THE INVENTION

The present invention relates to wall panels and wall panel systems. More particularly, the present invention relates to wall panels adapted to receive and retain detachable shelving hooks, and other accessories for displaying objects. Such wall panels and systems may be used to display merchandise in retail stores, display or store various items in residential homes or offices, as well as in other locations.

Generally, such systems are well known in the art. Many such systems typically include a slatted wall panel with a number of recessed slots extending linearly along the front surface. These slots typically extend horizontally, the recessed slots being in communication with undercuts on the upper sides of the respective slots to form an L-shaped slot. T-shaped slots may also be formed utilizing two such undercuts, one above the slot and one below.

Most slatted wall panels allow for insertion of particularly structured shelves, shelf brackets and hooks at any location along the recessed slot. Such items are L-shaped in cross section. Insertion is typically achieved by tilting the item to be inserted upward beyond a certain angle, generally around 45°, and inserting the item (specifically, the "foot" of the "L" shape) into the slot. Once inserted into the slot, the item may be rotated downward to its resting orientation where it is loosely retained within the slot by the "foot" of the "L" shape being within the undercut.

In designs of the type described above, the item is generally free to rotate back towards the angle of insertion. This is typically undesirable as, for instance, when items are placed on, for example, a shelf, users may dislodge the shelf from the slatted wall when removing the items. It is also undesirable because free space is required above or below an accessory to permit adequate space for the angled insertion. Thus, the density of display and the freedom of access is reduced.

Other systems are also known in the art. In some applications, a shelf supporting bracket may be slid into the slot from an open end of a slatted wall panel. Thus, if an accessory is inserted into one side, it may only be removed by sliding it back to that open end, or sliding it across the entire length of the panel to another open end.

Other wall display systems comprise panels having planar front surfaces including slats extended both horizontally and vertically along the front surface. In such display panel systems, items may be inserted into the slots where they are retained by a pressure fit. Once inserted into a slot, these items are retained in a fixed position, as their fitting mechanisms do not allow for sliding along the slots. One example of a system of this general type is U.S. Pat. No. 5,477,969 issued to Beeskau, et al.

Finally, wall display systems commonly referred to as "peg board" are known in the art. Such systems comprise a panel having spaced apertures. Accessories, such as hooks, may be inserted into the apertures. Items may then be stored or displayed on the hooks. Wall display systems of this type offer no mobility of the accessory once placed within an aperture.

Despite the wall panel systems of the prior art, there remains a need for a simple and efficient wall panel system with improved and versatile features.

SUMMARY OF THE INVENTION

Among the improved features of a wall panel of the present invention is the ability of accessories to be installed using a "plug and slide" technique. This technique calls for shaped openings within each slot of the wall panel with correspondingly shaped pieces on accessories to be connected to the wall panel. These shaped pieces may be inserted directly into the shaped openings of the wall panel, without the need to be tilted. Once inserted, they may be slid along the recessed slot and out of registration with the shaped openings where they are unable to be withdrawn from the wall panel. In this regard, the present invention may be characterized as a slatwall/pegboard hybrid, a pegboard with accessory mobility, or a slatwall with pegboard qualities. The shaped pieces may be fabricated to fit snugly to the recessed slot, representing an improvement to the loose fit of conventional slatwall or pegboard systems. This plug and slide feature serves as one basis of a variety of accessories for the present invention.

Another improved feature of the present invention is the flexibility of variously sized modular tiles which may be used in various configurations including continuous grids or scattered individual tiles. Typical slatwall or pegboard systems are sold in large sheets which must be cut to fit particular installation locations. The system of the present invention may be adapted to any horizontal or vertical surface, including ceilings, typically without requiring cutting and fitting. Such modularity is not simple scaling of panels as the features of the panel system preferably remain constant (e.g., the size of the slots and shaped openings) even as the overall size of the panel varies.

The present invention also contemplates methods for creating slatted wall panels of the type disclosed herein, either from original manufacture or by retrofitting existing slatted wall panels. Such retrofitting may include the use of specially designed jigs.

One aspect of the present invention is a wall panel for holding an accessory. In one embodiment of the wall panel, the wall panel comprises a recessed slot, at least a portion of which having an undercut, and a shaped opening in communication with a portion of the recessed slot and the undercut. The shaped opening is capable of receiving a shaped attachment member of an accessory. The shaped attachment member may then be slid within the undercut and the recessed slot beyond the limits of the shaped opening.

The wall panel may further comprise slots adjacent to the recessed slot. If so provided, the shaped opening may extend into at least one of the slots.

The wall panel may further comprise a first side edge and an opposed second side edge. It may also include a first end edge and an opposed second end edge extending between the first side edge and second side edge. The recessed slot may be in communication with the first end edge.

The shaped opening may be in communication with the first side edge or the first end edge.

The shaped opening may be in communication with both the first end edge and the first side edge.

The shaped opening may be interior of the edges and the shaped attachment member of an accessory may be detachable from the wall panel when aligned with the shaped opening.

Where the shaped opening is interior of the edges, the wall panel may comprise an additional shaped opening in communication with the first end edge.

Where the shaped opening is interior of the edges, the wall panel may comprise an additional shaped opening in communication with the first end edge and the first side edge.

The wall panel having first and second side edges and first and second end edges may also include a female recess along one of the first end edge, the second end edge, the first side edge, or the second side edge.

The wall panel having first and second side edges and first and second end edges may also include at least one male protrusion extending from one of the edges.

Another aspect of the present invention is a wall panel system comprising a plurality of wall panels for holding an accessory, each of the panels comprising a recessed slot, at least a portion of which having an undercut, and a shaped opening in communication with a portion of the recessed slot and the undercut. The shaped opening may be capable of receiving a shaped attachment member of an accessory. The shaped attachment member may then be slidable within the undercut and the recessed slot beyond the limits of the shaped opening.

The shaped openings of the wall panel may be substantially round.

The shaped openings of the wall panel may be substantially square and the wall panel may be mounted in a vertical orientation.

The shaped openings of the wall panel may be a logo, design, symbol or device that is associated with a company, individual or group.

The wall panel may be mounted on a ceiling.

The accessory used in conjunction with the wall panel may further comprise a rail insertable into the recessed slot of the wall panel.

Where the accessory to be used with a wall panel includes a rail, the rail may be in communication with the shaped attachment member.

In another aspect of the invention, the wall panel may comprise a first backing strip, a second backing strip, and a plurality of facing strips attached to the backing strips. At least one of the facing strips may include a shaped recess. The facing strips may be in communication with the backing strips so as to form an undercut in communication with the shaped recess. The shaped recess may be capable of receiving a shaped attachment member of an accessory. The shaped attachment member may then be slidable within the undercuts adjacent to the shaped recess beyond the limits of the shaped recess.

Each of the backing strips may include a slot adjacent to a plurality of raised portions. The facing strips may be attached to the raised portions of the backing strips.

The raised portions of the backing strips may include a protruding member and each of the facing strips may include plurality of apertures extending therethrough. If so provided, the protruding members may fit within the apertures to attach the facing strips to the backing strips.

A plurality of wall panels wherein each of the wall panels includes first backing strip, a second back strip and a plurality of facing strips attached to the backing strips may also be provided. At least one of the facing strips may include a shaped recess. The facing strips may be in communication with the backing strips to form an undercut in communication with the shaped recess. The shaped recess may be capable of receiving a shaped attachment member of an accessory, the shaped attachment member then being slidable within the undercuts adjacent to the shaped recess beyond the limits of the shaped recess.

In another aspect of the invention, a wall panel system comprising at least one wall panel and at least one accessory may be provided. Each of the wall panels may comprise a recessed slot, at least a portion of which having an undercut, and a shaped opening in communication with a portion of the recessed slot and the undercut. The accessory may include a shaped attachment member wherein the shaped opening and the undercut are capable of receiving the shaped attachment member of the accessory. The shaped attachment member may then be slidable within the undercut and the recessed slot beyond the limits of the shaped opening.

A plurality of such wall panels may be provided wherein at least one of the wall panels is adjacent to one other of the wall panels.

Where a plurality of such wall panels are adjacent, the recessed slots and the undercuts of the adjacent wall panels may align.

A plurality of such wall panels may be provided wherein each of the wall panels comprises a first side edge and an opposed second side edge, a first end edge and an opposed second end edge extending between the first side edge and the second side edge and a female recess along one of the edges.

In this wall panel system, a nib having a first portion and a second portion may also be provided. The first portion and the second portion may be in registration with the female recesses of the wall panels such that the first portion may be inserted into the female recess of one of the wall panels while the second portion is inserted into the female recess of another of the wall panels adjacent to the first wall panel.

Each of the wall panels may further comprise a male protrusion on one of the edges such that the male protrusion is in registration with the female recess provided on one of the edges of another of the wall panels.

In the wall panel system comprising at least one wall panel and at least one accessory wherein each of the wall panels comprises a recessed slot, at least a portion of which having an undercut, and a shaped opening in communication with a portion of the recessed slot and the undercut, and where the accessory includes a shaped attachment member wherein the shaped opening and the undercut are capable of receiving the shaped attachment member of the accessory, and wherein the shaped attachment member is slidable within the undercut and the recessed slot beyond the limits of the shaped opening, each of the wall panels may further comprise a first side edge and an opposed second side edge, and a first end edge and an opposed second end edge extending between the first side edge and the second side edge. At least one of the panels may further comprise a female recess along one of the edges and another one of the panels may further comprise a male protrusion along one of the edges such that the female recess of one of the panels is in registration with the male protrusion of another of the panels.

In the wall panel system comprising at least one wall panel and at least one accessory previously described, the accessory may be selected from the group consisting of a bracket, a shelf, a cubbie, a modular accessory, or plug and slide hardware.

The accessory may further comprise a rail insertable into the recess slot of the wall panel.

The rail may be in communication with the shaped attachment member.

In a wall panel system where the accessory is a bracket, the bracket may include a first extension and a second extension extending perpendicularly therefrom. The first extension may be capable of supporting a shelf and the shaped attachment member may be in communication with the second extension. The wall panel system may further comprise a shelf supported on the first extension of the bracket.

The first extension may include shelf guides extending therefrom. The shelf may include grooves capable of receiving the shelf guides to secure the shelf upon the first extension.

In a wall panel system where the accessory is a shelf, the shelf may include a back member and a shelf member extending perpendicularly therefrom. The back member may be in communication with the shaped attachment member such that the back member is adjacent to the wall panel when the shaped attachment member is inserted into the shaped opening.

The back member may include an aperture to facilitate alignment of the shaped attachment member of the shelf with the shaped opening of the wall panel.

The shelf may further comprise a rail in communication with the back member. The rail may be capable of being inserted into the recessed slot of the wall panel.

Each of the back member and the shelf member may include a first side edge and an opposed second side edge. The shelf may further include a first side member in communication with the first side edge of each of the back member and the shelf member and a second side member in communication with the second side edge of each of the back member and the shelf member.

In a wall panel system where the accessory is a cubbie, the cubbie may comprise a back member and a shelf member extending perpendicular therefrom. Each of the back member and the shelf member may include a first side edge and an opposed second side edge. The cubbie may further comprise a first side member in communication with the first side edge of each of the back member and the shelf member and a second side member in communication with the second side edge of each of the back member and the shelf member, and a roof member in communication with the first side member, the second side member and the back member.

The back member may include an aperture to facilitate alignment of the shaped attachment member of the shelf with the shaped opening of the wall panel.

The cubbie may further comprise a rail in communication with the back member.

The rail may be capable of being inserted into the recessed slot of the wall panel.

In a wall panel system where the accessory is a modular accessory, the modular accessory may comprise a back plate with an aperture. The shaped attachment member may be in communication with the back plate.

The aperture may be a snap-in aperture. If so provided, the modular accessory may further include a snap in module, the module having a portion capable of being fitted within the snap-in aperture.

In a wall panel system where the accessory is plug and slide hardware, the hardware may comprise a rail. The shaped attachment member may be in communication with the rail.

In a wall panel system, the shaped attachment member may be T-shaped in cross section.

In a wall panel system, the shaped attachment member may be L-shaped in cross section.

Another aspect of the present invention is a method of converting a conventional wall panel having a front surface, a recessed slot and an undercut, so as to permit the conventional wall panel to accept an accessory having a shaped attachment member. The method comprises the step of forming at least one shaped opening in communication with the slot and the undercut. The shaped opening must be large enough to accept a shaped attachment member of an accessory at an insertion angle generally normal to the front surface of the conventional wall panel. The shaped attachment member may then be slidable within the slot and the undercut beyond the limits of the shaped opening.

The method of converting conventional wall panel may further comprise the step of providing a jig. The jig may have a hole forming guide extending therethrough a rail capable of being inserted into the recessed slots of the conventional wall panel so as to align the jig along a first access.

The step of forming at least one shaped opening in the method of converting conventional wall panel may comprise the step of inserting a hole forming device into the hole forming guide to form the at least one shaped opening.

The step of providing a jig in the method of converting conventional wall panel may include providing a jig having a viewing aperture. The method may further comprise the step of aligning the viewing aperture with an already formed shaped opening so as to align the jig along the first axis prior to forming an additional shaped opening at a predetermined interval along the first axis.

The step of providing a jig in the method of converting conventional wall paper may include providing a jig in which the hole forming guide includes a depth guide to provide an indication that the shaped opening being formed is in communication with the undercut of the conventional wall panel.

The step of providing a jig in the method of converting conventional wall panel may also include providing a jig in which the hole forming guide includes a stop to prevent further hole formation once the shaped opening being formed is in communication with the recessed slot.

In the method of converting a conventional wall panel wherein the wall panel further comprises a plurality of slots adjacent to the recessed slot, the step of forming at least one shaped opening in communication with the slot and the undercut further includes forming the shaped opening within one of the plurality of slots.

Another aspect of the present invention is a method of forming wall panel comprising the steps of providing a relatively planar board, milling the board to form a recessed slot and undercut within the board, and forming a shaped opening in the board beyond the limits of the recessed slots so as to form a shaped opening extending into the undercut. The shaped opening and undercut may be capable of receiving a shaped attachment member of an accessory. The shaped attachment member may be slidable within the undercut and the recessed slot beyond the limits of the shaped opening.

Another aspect of the present invention is a method of forming wall panel comprising the steps of providing a relatively planar board, milling the board to form a slot adjacent to a plurality of raised portions, providing a plurality of facing strips, one of the facing strips including a shaped recess, and attaching the facing strips to the raised portions of the board to form undercuts above the slot. The shaped recess and the undercuts may be capable of receiving a shaped attachment member of an accessory, shaped attachment member being slidable within the undercut and the slot beyond the limits of the shaped recess.

In this method of forming wall panel, the step of attaching the facing strips to the raised portions of the board may be achieved mechanically or chemically, or by a combination thereof.

This method of forming wall panel may further comprise the steps of providing apertures through the raised portions, providing apertures through the facing strips, and aligning the apertures of the raised portions with the apertures of the facing strips, wherein the step of attaching the facing strips to the raised portions of the board is achieved mechanically.

The raised portions of the board in this method of forming wall panel may further include protruding members. The method may further include the step of providing apertures through the facing strips. If so provided, the step of attaching the facing strips to the raised portions of the board may be achieved by inserting the protruding members through the facing strip apertures to form undercuts above the slot.

A further aspect of the present invention is a method of forming wall panel comprising the steps of providing a plurality of backing strips, providing a plurality of facing strips, at least one of the facing strips including a shaped recess, and attaching the plurality of facing strips to the backing strips to form a plurality of undercuts. In this method, the shaped recess may be capable of receiving a shaped attachment member of an accessory. The accessory may then be slidable within the undercuts adjacent the shaped recess beyond the limits of the shaped recess.

In this method, the backing strips may further comprise a slot adjacent to a pair of raised portions. The step of attaching the plurality of facing strips to the backing strips to form a plurality of undercuts may include attaching the facing strips to the raised portions of the backing strip.

Another aspect of the present invention is an accessory for use with a wall panel having a recess slot with an undercut and a shaped opening in communication with a portion of the recessed slot and the undercut. The accessory may have a shaped attachment member capable of being inserted into the shaped opening of the wall panel. The shaped attachment member may be slidable within the undercut and the recessed slot beyond the limits of the shaped opening.

The shaped attachment member of the accessory may have a T-shaped cross section.

The shaped attachment member of the accessory may include an extension member fitting within the slot of the wall panel and a shaped piece fitting within the undercut of the wall panel.

The shaped attachment member of the accessory may include a shaped piece. The shaped piece may form a shape selected from the group consisting of circular, triangular, square, rectangular, pentagonal, hexagonal, hexagonal, octagonal, star shaped or oval.

A still further aspect of the present invention includes a wall panel system comprising a wall panel and an accessory. The wall panel may have a first region and a second region. The first region may further comprise a recessed slot, at least a portion of which having an undercut, and a shaped opening in communication with a portion of the recessed slot and the undercut. The shaped opening may be capable of receiving a shaped attached member of an accessory. The second region may comprise conventional wall panel having a recessed slot and an undercut. The conventional wall panel may be converted so as to permit the conventional wall panel to accept an accessory having a shaped attachment member. The accessory may have a shaped attachment member capable of being inserted into the shaped opening of the first and second region. The shaped attachment member may be slidable within the undercut and the recessed slot beyond the limits of the shaped opening.

Another aspect of the present invention includes a method of installing an accessory into a wall panel having a recessed slot, an undercut and a shaped opening in communication with the recessed slot. The accessory may include a projecting member. The method comprises the steps of inserting the projecting member of the accessory into the shaped openings substantially without tilting the accessory from the orientation in which it will be installed on the wall panel, and sliding the accessory in the recessed slot so that a portion of the projecting member extends into an undercut.

DETAILED DESCRIPTION

Figure 1:
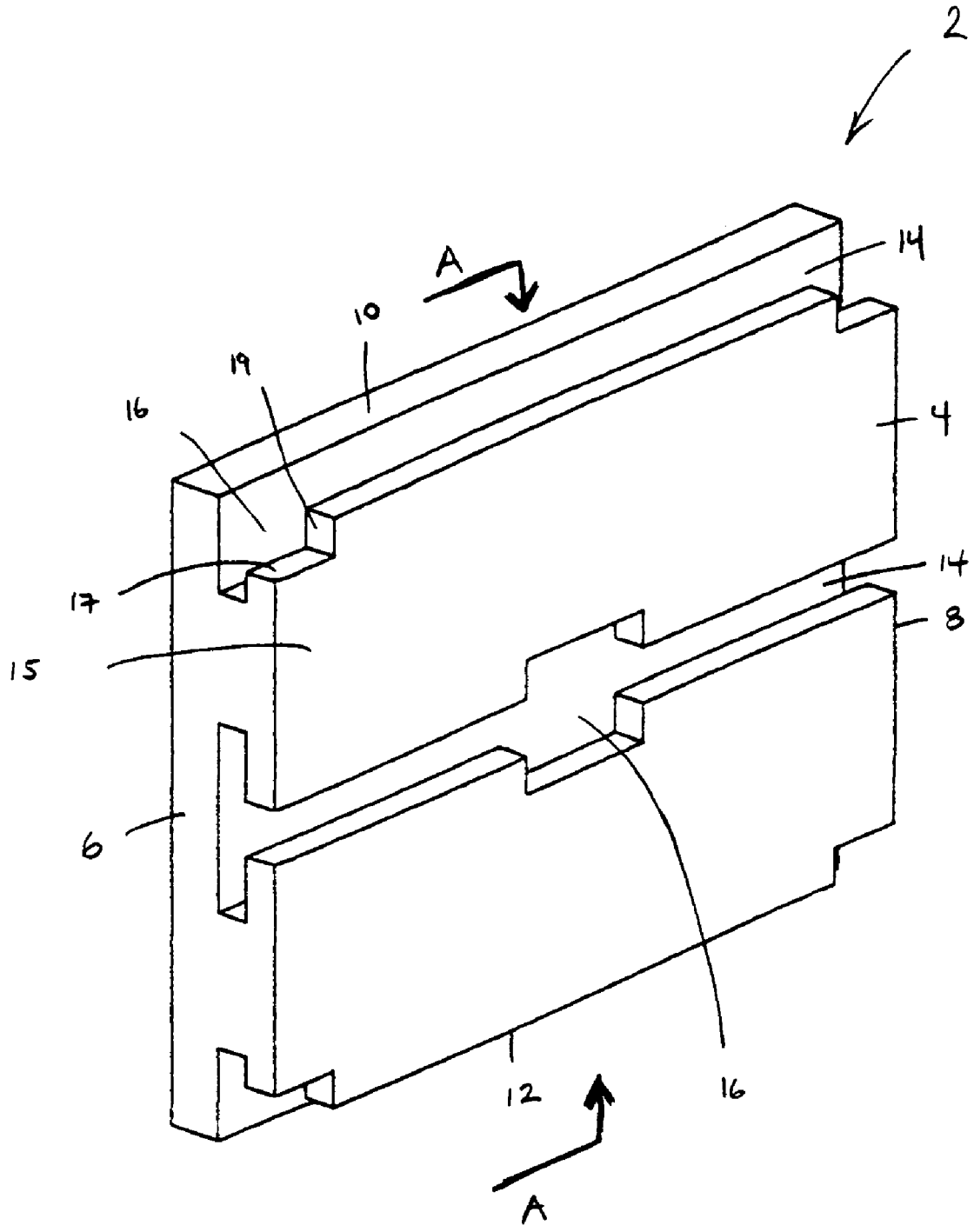
FIG. 1 depicts a perspective view of a wall panel in accordance with the first embodiment of the present invention.

In the following is described the embodiments of the wall panel and system of the present invention. In describing the embodiments illustrated in the drawings, specific terminology will be used for the sake of clarity. However, the invention is not intended to be limited to the specific term so selected, and it is to be understood that each specific term includes like structures, devices and materials, as well as technical equivalents that operate in a similar manner to accomplish a similar purpose. For example, while the invention refers to "wall panels," and to accessories that are to be connected, supported and/or associated with a "wall panel," the invention claimed and described herein is not limited to walls or surfaces that are vertical, and may apply to orientations that are angled or horizontal, such as ceilings. The term "accessory" as used herein shall mean any item to be connected to a wall panel, and shall include, but not be limited to, shelving brackets, shelving, connectors to hold any item, cubbies, and other items discussed herein.

Referring to the figures, FIG. 1 depicts a perspective view of a wall panel 2 in accordance with the first embodiment of the present invention. A portion of the front surface 4 is preferably planar or generally planar, and in one preferred embodiment a major portion of the front surface 4 of the entire front surface 4 is planar or generally planar. The panel 2 also includes first side edge 6 and second side edge 8. Extending between first side edge 6 and second side edge 8 are top edge 10 and bottom edge 12.

The wall panels 2 of one embodiment also include recessed slots 14 extending between the first side edge 6 and second side edge 8. Of course, a single panel may have one or more recessed slots. As shown in FIG. 1, the panel 2 includes a single slot (in the center) and portions of yet to be formed slots (on the upper end lower edges). The recessed slots 14 define slats 15 in the generally planar front surface 4 of the wall panel 2.

The slots 14 include an undercut which is in communication with the slot and extends under a slot, preferably the upper slot. In the preferred embodiment, the undercut extends in both directions—upper and lower—to form a "T-shaped" cross-section, as will be discussed below. The undercuts in the preferred embodiment form the short extensions of the "T".

Preferably, within each recessed slot 14 are included shaped openings 16. The shaped openings 16 of the preferred embodiment, as shown in FIG. 1, are rectilinear voids with edges defining a square. It will be appreciated, however, that any shape may be utilized. Preferably, such shapes should be reproducible. Ease of construction should be considered in establishing a desired shape if cost is a consideration. Simple shapes such as squares and circles are very effective, easy to create, and may be preferred. However, stars, triangles and non-uniform geometric shapes or non-geometric shapes may also be used to provide a particular overall design or theme in the wall panel system, particularly if the accessories to be fitted within the shape are molded. For instance, a shaped opening may be a logo, design, symbol or device that is associated with a company, individual or group. Even artwork may be used. By way of example, the shape of the head of Mickey Mouse®, a Disney® character and icon, may be used as a shaped opening, thus establishing a Disney® theme in a wall panel system. Mickey Mouse® and Disney® are registered trademarks of Disney Enterprises, Inc. 500 South Buena Vista Street, Burbank, Calif. 91521.

The shaped opening can also form part of an overall design on a panel system, the other part of the design being incorporated, by printing, wallpaper or otherwise, on the slats. Additional details with regard to shaped openings will be provided hereinafter.

As is shown in FIG. 1, the preferred embodiment of the wall panel 2 includes one shaped opening 16 located in the center of the panel along recessed slot 14. Of course, depending on the size of an individual panel, or the size of the system being developed, the wall panel can include more than one shaped opening 16 and/or more than one recessed slot. Portions of additional shaped openings 16 are also located at each corner of the wall panel 2. More specifically, one quarter of a shaped opening 16 is located at the intersection of first side edge 6 and top edge 10, one quarter of another shaped opening is located at the intersection of top edge 10 and second side edge 8, one quarter of another shaped opening 16 is located at the intersection of second side edge 8 and bottom edge 12, and one quarter of a shaped opening 16 is located at the intersection of bottom edge 12 and first side edge 6. Each of the top edge 10 and bottom edge 12 bisects a recessed slot 14 in communication with the respective shaped openings 16 located at the corners of the slatted wall panel 2. Panels 2 need not be square or rectangular, but can be any suitable shape that could communicate with other panels to form an overall panel, or to comprise a panel in and of itself. Preferably, such panels 2 include at least one straight edge so the panel may communicate with another such panel along that edge. Preferable additional geometric shapes include triangular, pentagonal, hexagonal, heptagonal and octagonal.

Figure 2:
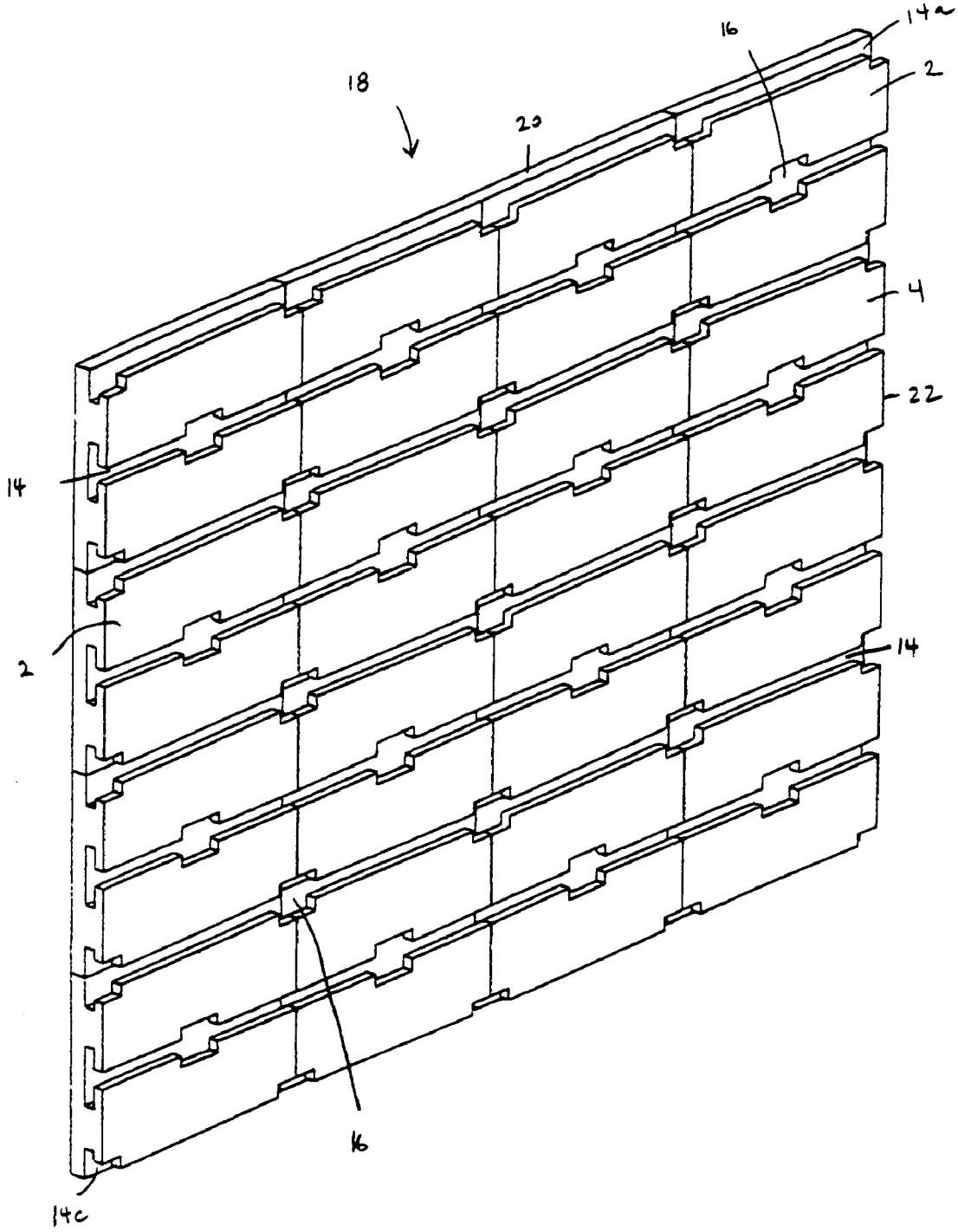
FIG. 2 depicts an array of wall panels as shown in FIG. 1.

When individual slatted wall panels 2 are combined in accordance with this preferred embodiment, a plurality of such panels may be arranged in an array 18 such as the one shown in FIG. 2. It will be appreciated that the array 18 shown in FIG. 2 comprises sixteen individual slatted wall panels 2. The top edge 20 of the array shown in FIG. 2 is also equal in length to the side edge 22. However, other configurations are possible. Depending on the needs of the particular user, the top edge 20 and side edge 22 of the array 18 may be assembled to lengths which are multiples of the lengths of the top edge 10 and second side edge 8 of an individual wall panel 2. For example, the array may be ten wall panels 2 wide by three panels tall. In addition, the panels need not be continuous. Panels may alternate to form a checkered appearance (or any other desired appearance), or put together in any other manner as desired by the installer. Of course, panels that are not square or rectangular can be used to provide interesting designs.

In a preferred embodiment, wall panels 2 may be constructed of standard sizes. A typical panel may therefore be a 12 inch by 12 inch square, and may be slatted. The slatted wall panel 2 may also be provided in modular sizes, which in varied combinations allow the installer flexibilities of configuration not available in conventional slat wall sold in large sheets to be cut to size. The slatted wall panel of the present invention is such that it may be assembled from various sized modules. Accordingly, in this and other respects, it is an improvement over prior systems, many of which are geared safely towards professionally installed commercial systems over large surfaces, such as a large display wall. The modularity of the present invention permits assembly in smaller or odd-shaped surfaces. This can be accomplished without the need for the installer to use cutting tools. As such, the system is highly adaptable to areas which abound in most every home, such as kitchen backsplashes, backs of closet doors, sides of furniture, patches of bathroom or bedroom walls, storage closets, workbenches, etc. The slatted wall panels 2 may also be cut or built to fit a specific application in the field, or may be custom manufactured to specific sizes. Depending on the materials of construction and the sophistication of the installer, the panels may also be trimmed to size during installation.

Upon formation of the array 18 of slatted wall panels 2 in accordance with the first embodiment of the present invention, it will be appreciated that the portions of the shaped openings 16 occurring at the corners of each slatted wall panel will form full-sized shaped openings 16 at each location where four panels intersect. Similarly, the recessed slots 14*a* and 14*c* occurring at the top edge 10 and bottom edge 12 of each panel will form full-sized recessed slots 14 in the areas where two panels abut each other at the top edge of one and the bottom edge of another.

Figure 3:
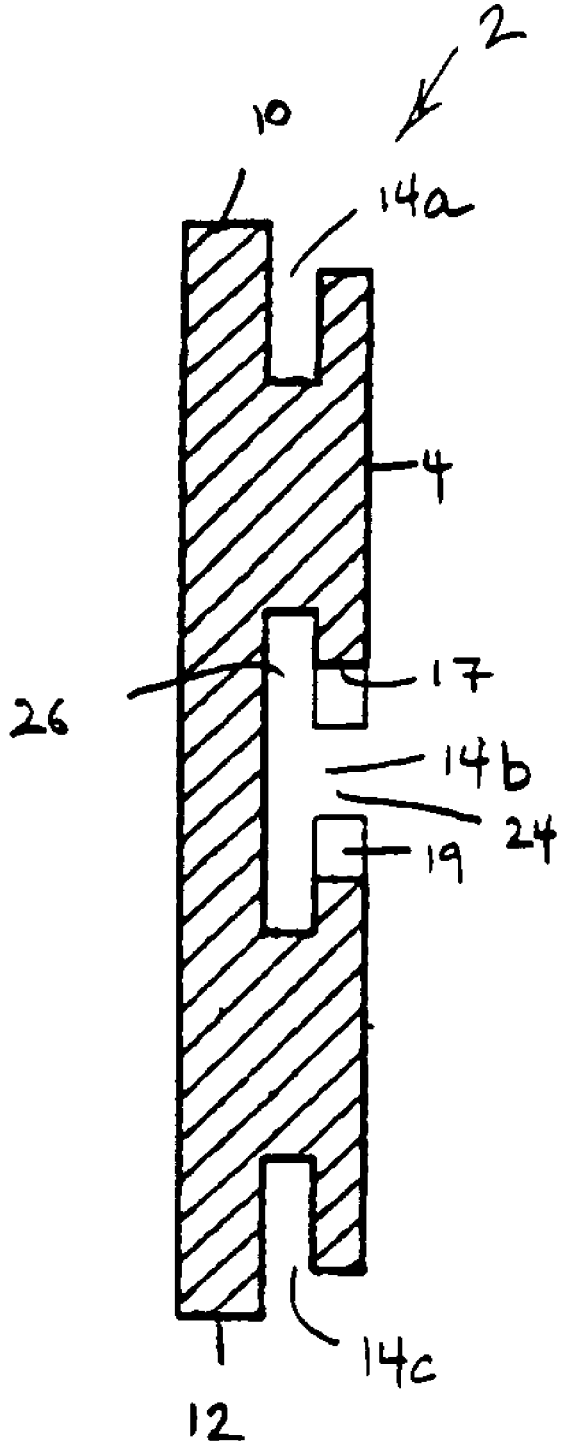
FIG. 3 depicts a cross-sectional view of the wall panel shown in FIG. 1.

FIG. 3 depicts a cross-sectional view of the slatted wall panel 2 taken along section line A—A of FIG. 1. In this preferred embodiment, first side edge 6 includes three recessed slots 14. The upper most recessed slot 14*a* and lower most recessed slot 14*c* are bisected by top edge 10 and bottom edge 12, respectively. As such, 14*a* and 14*c* are only portions of a full recessed slot 14, formed when two panels abut. Recessed slot 14*b* is a full-sized recessed slot. Of course, a full slot may not be required, depending on the cross-sectional shape of the shaped member of an accessory. For instance, the slot 14*c* includes an undercut such that an "L-shaped" member may be plugged into a shaped opening 16 (FIG. 1) and slid into the undercut to be held thereby.

Portions of the shaped openings 16 occurring at the corners of the panel 2 form a first ledge 17, parallel to slot 14 and second ledge 19, perpendicular to slot 14. As is shown, recessed slot 14*b* forms in cross-section, the shape of a "T". Recessed slot 14*b* comprises a first section 24 extending perpendicularly into the front surface 4 of slatted wall panel 2. The first section 24 extends into an elongated second section 26 extending generally parallel to front surface 4 to form the T. Of course, other cross-sectional shapes may be used as well. For example, an "L-shaped" cross-section may also be used. The common features is the undercut—in the "T" forming one of the short extensions of the "T"; while in the "L" forming the "foot" of the "L".

As previously stated, the recessed slot 14*a* along the top edge 10 of one slatted wall panel 2 may be placed in communication with the recessed slot 14*c* along the bottom edge 12 of another slatted wall panel 2 to create a full recessed slot 14 of the type shown in 14*b*. This feature is shown in FIG. 2, where an array 18 of slatted wall panels 2 are shown.

Figure 4:
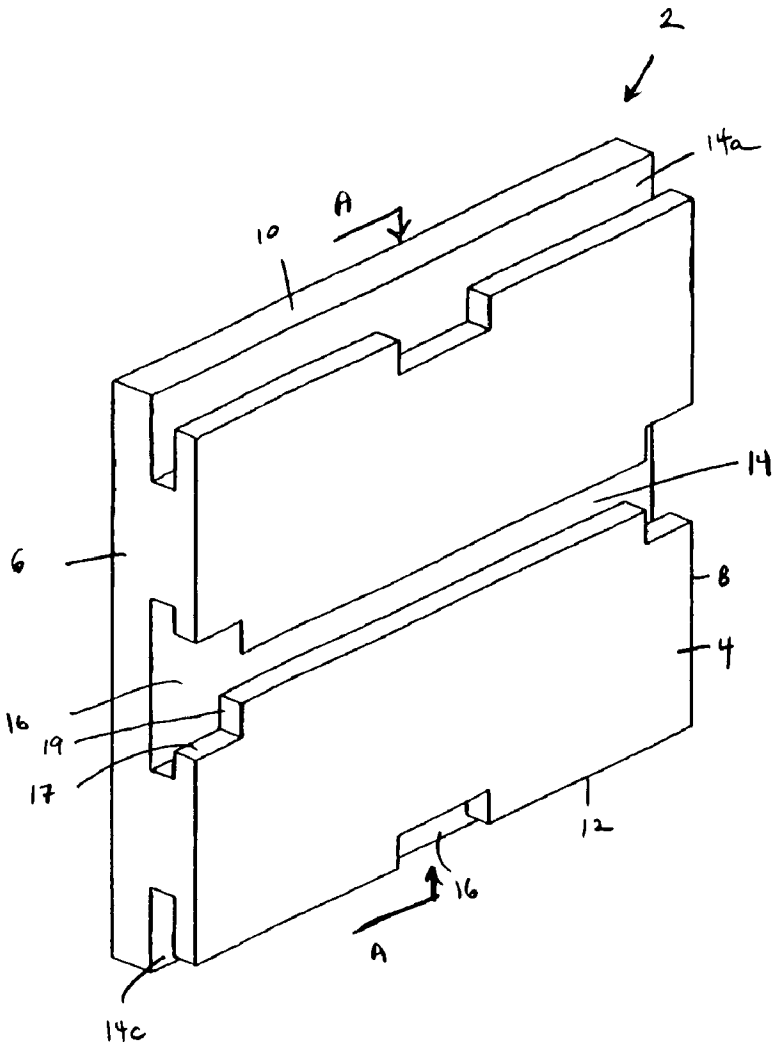
FIG. 4 depicts a perspective view of a wall panel in accordance with a second embodiment of the present invention.

FIG. 4 depicts a slatted wall panel 2 in accordance with a second embodiment of the present invention. This embodiment is similar to the first embodiment, except partial shaped openings 16 are located at the midpoints of the outer edges 6, 8, 10, 12 of the panel, rather than at the corners and in the center. Of course, this construction can be combined with one or more shaped openings located inward of the edges to communicate with one or more recessed slots and undercuts. One recessed slot 14 may also be provided at each of top edge 10 and bottom edge 12. These recessed slots 14 are bisected by the respective edge 10, 12. A partial shaped openings 16 may be located at the midpoints of top edge 10, first side edge 6, bottom edge 12, and second side edge 8. Each of the partial shaped openings are bisected by the respective edge 6, 8, 10, 12. An additional recessed slot 14 may connect the shaped openings 16 located at first side edge 6 and second side edge 8.

As with slatted wall panel 2 of the first embodiment, slatted wall panel 2 of the second embodiment may be arranged in an array as well. The array is constructed in much the same manner as the array 18 shown in FIG. 2. In this regard, first side edge 6 of one the slatted wall panels 2 may be placed in communication with second side edge 8 of another slatted wall panel. If so arranged, the partial shaped openings 16 bisected by first side edge 6 and second side edge 8 will combine to create full-sized shaped openings 16. Subsequent slatted wall panels 2 may be added until the array is constructed to a required length. To build the array in the perpendicular direction, additional slatted wall panels 2 may be placed such that top edge 10 of the additional slatted wall panel is communication with bottom edge 12 of the previously placed slatted wall panels, or vice-versa. Additional slatted wall panels 2 may be added in this manner until the array is sized for its particular purpose. This arrangement will form full sized recessed slots 14 and shaped openings 16 at the abutment points of multiple panels.

Figure 5:
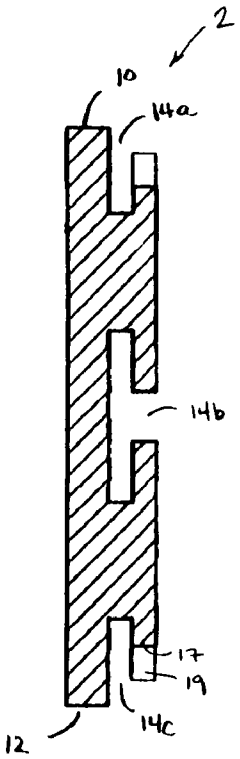
FIG. 5 depicts a cross-sectional view thereof.

FIG. 5 depicts a cross-sectional view of first side edge 6 of a slatted wall panel 2 in accordance with the second embodiment of the present invention taken along section line A—A of FIG. 4. As with the first embodiment, slatted wall panel 2 of the second embodiment includes a recessed slot 14*a* at top edge 10, a recessed slot 14*c* at bottom edge 12 and a recessed slot 14*b* therebetween. Recessed slot 14*b* is a full recessed slot while 14*a* and 14*b* are bisected by the respective edge 10, 12. First ledges 17 and second ledges 19 are also created by the recessed slots 16. Again, first ledges 17 are oriented parallel to slots 14 while second ledges 19 are perpendicular thereto.

Figure 6:
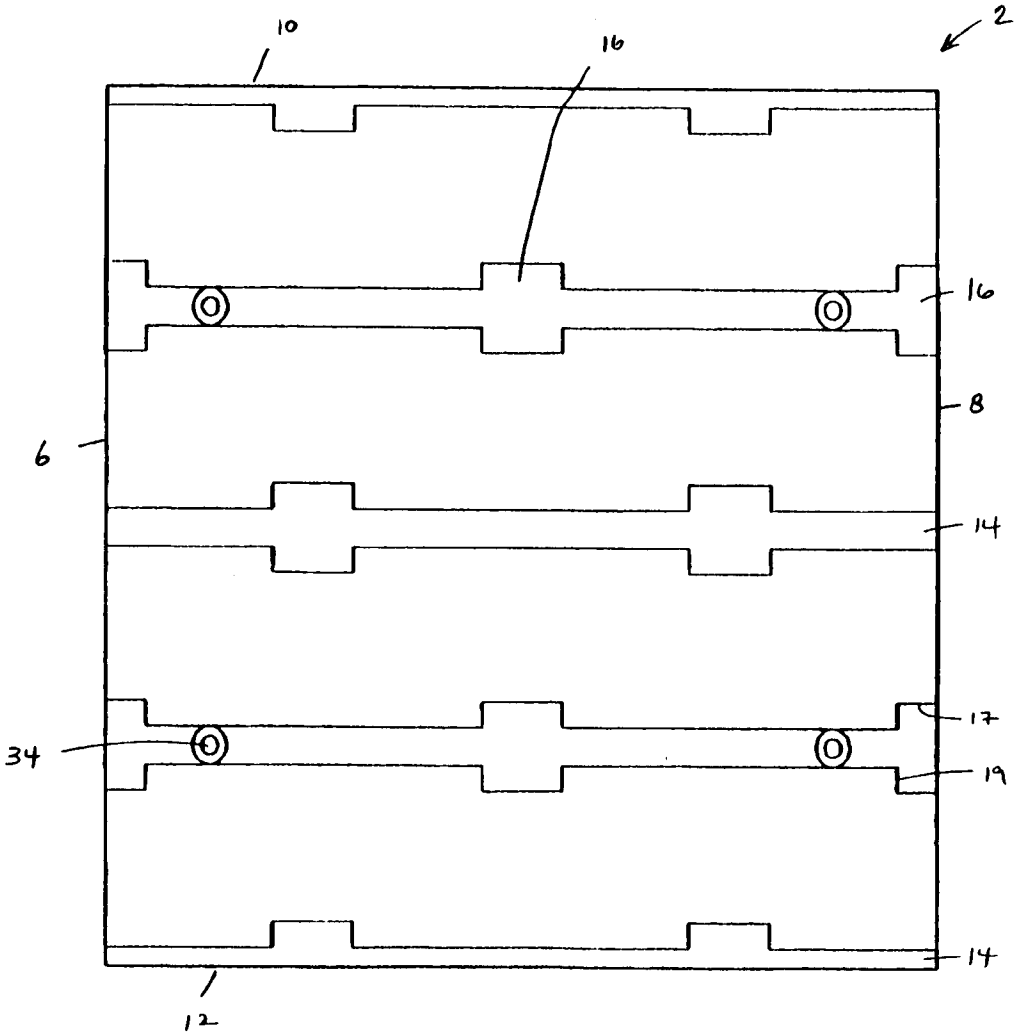
FIG. 6 depicts a frontal plan view of a wall panel in accordance with the third embodiment of the present invention.

FIG. 6 depicts a front elevational view of a slatted wall panel 2 in accordance with a third embodiment of the present invention. It will be appreciated that the embodiment shown in FIG. 6 combines features of both the first embodiment shown in FIG. 1 and the second embodiment shown in FIG. 4. As such, the slatted wall panel 2 of FIG. 6 includes a plurality of recessed slots 14 and a plurality of shaped openings 16. The shaped openings 16 are dispersed at even intervals along the recessed slots 14. Several of the shaped openings 16 are disposed in the interior area of the slatted wall panel 2 as disclosed in the first embodiment and are full-sized shaped openings 16. Partial shaped openings 16 are disposed along the edges 6, 8, 10, 12 substantially as described in the second embodiment.

It will also be appreciated that the slatted wall panel 2 of the third embodiment may be designed to be either smaller or larger than the slatted wall panel 2 depicted in FIG. 6 without departing from the spirit or function of the present invention. Similarly, the number and spacing of shaped openings 16 and recessed slots 14 may vary in frequency.

The wall panel shown in FIG. 6 has three recessed slots 14 extending horizontally along the interior of the panel, a recessed slot bisected by the top edge 10, and a recessed slot bisected by the bottom edge 12. Each of these recessed slots 14 includes full or partial shaped openings 16, forming first ledges 17 and second ledges 19.

It will be noted that the slatted wall panel shown in FIG. 6 contains holes 34. These holes 34 are provided so that the slatted wall panel 2 may be affixed to the surface where it is intended to be used. Such affixation may be accomplished mechanically, such as with screws, bolts, nails or other suitable fasteners. If additional support is required, more holes 34 may be used. In addition, other affixation expedients may be provided, including adhesives along the back edge, Velcro, magnets, brackets, or other means. Various combinations may also be used.

Thus far, each of the wall panels 2 depicted have included slots 14 extending to an edge 6, 8. It will be appreciated that the slots 14 may, however, not extent to an edge 6, 8. Rather, the slots 14 may be contained entirely within the perimeter of the wall panel 2.

Figure 7:
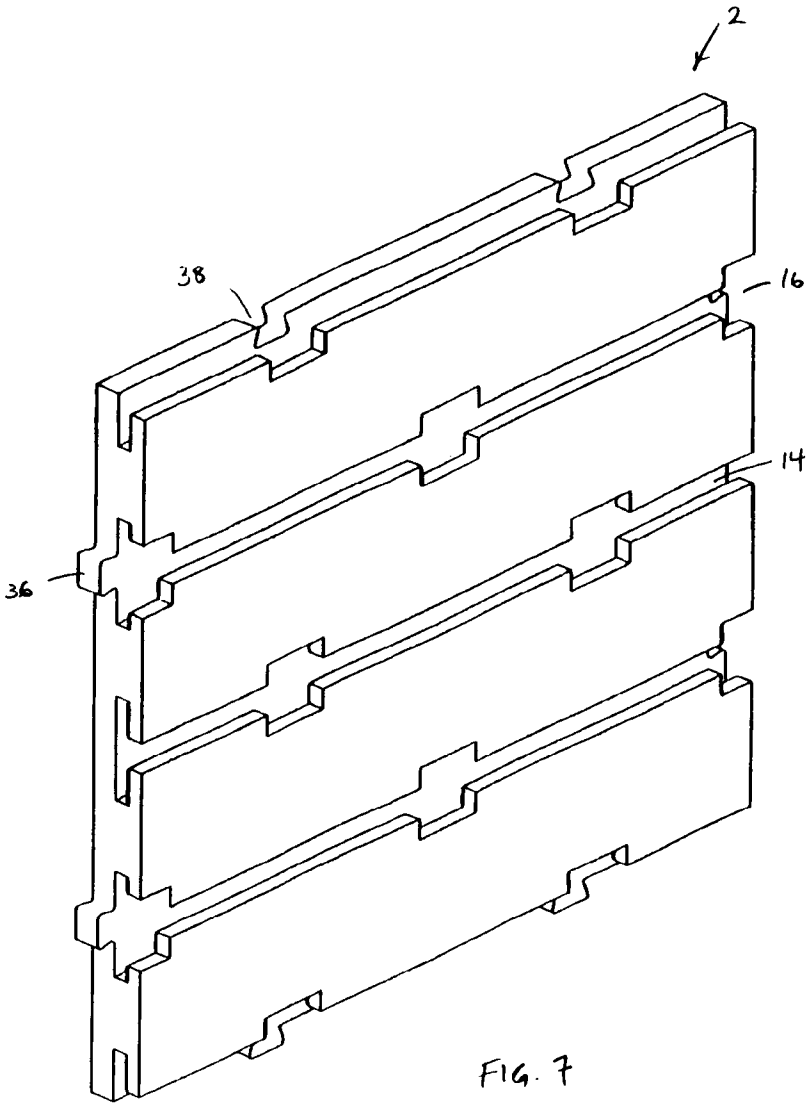
FIG. 7 depicts a perspective view of the wall panel in accordance with another embodiment of the present invention.
Figure 8:
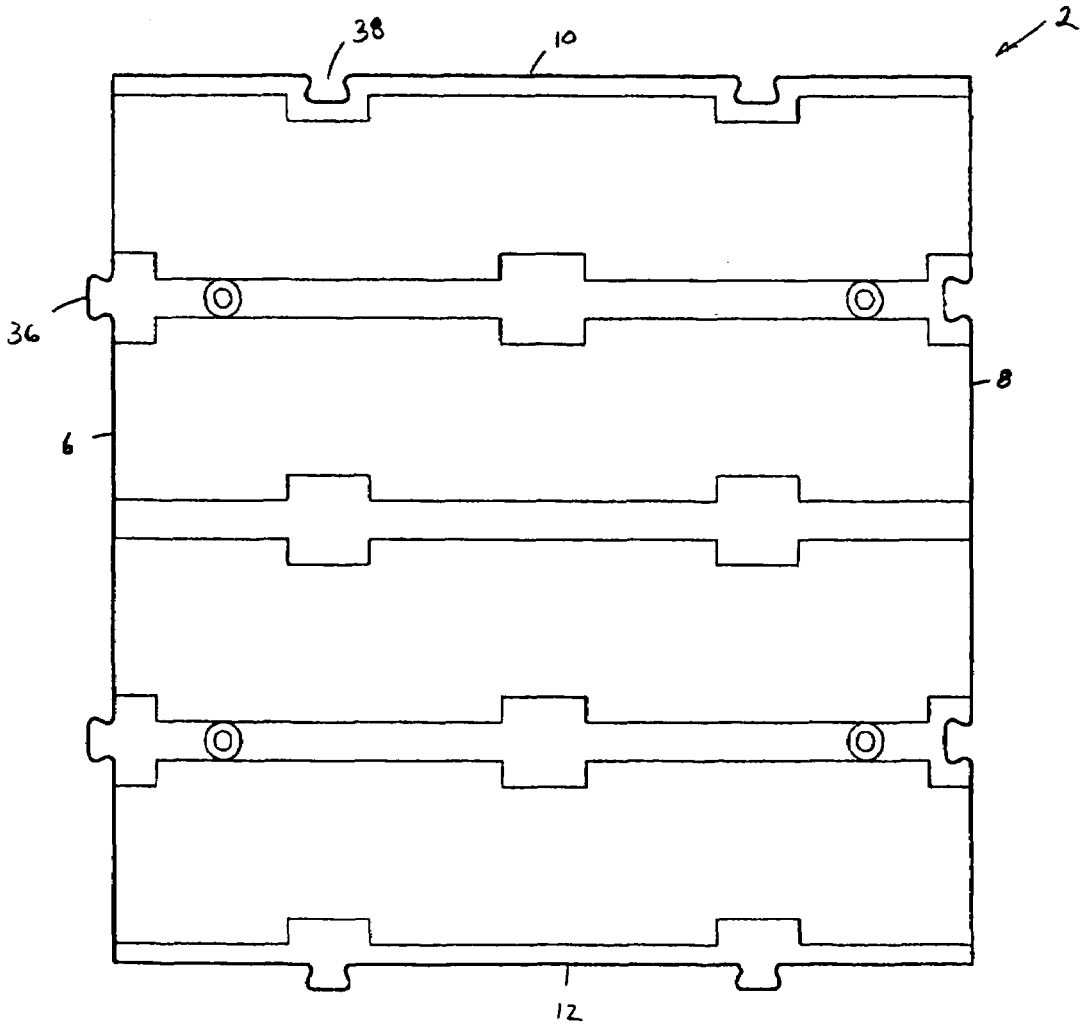
FIG. 8 depicts a wall panel in accordance with another embodiment of the present invention.

In instances where the slatted wall panels 2 are used to form arrays 18, male locking and/or registration nibs 36 and female recesses 38 may be provided. Examples of such male nibs 36 and female recesses 38 are shown in FIG. 7. When such male nibs 36 and female recesses 38 are provided, a male nib 36 on one panel 2 will be in registration with a female recess 38 on an adjacent panel. Such an arrangement aids in the installation of neighboring panels 2 in both the correct orientation and such that the recessed slots 14 and shaped openings 16 properly align. Proper alignment enables the slatted wall panel 2 to be constructed with tighter tolerances than may otherwise be provided. FIG. 8 depicts a front elevational view of a slatted wall panel 2 provided with male nibs 36 and female recesses 38. It will be appreciated that the pear-shaped construction of the nibs 36 and recesses 38 is only a preferred embodiment to assist in registration and locking. They provide positive locking to prevent adjacent panels 2 from pulling apart. Other nib 36 and recess 38 shapes may also be used. Some of which, such as rectangular nibs 36 and recesses 38, may only resist movement of the panels 2 in one direction rather than two, and/or just provide a registration function.

The male nibs 36 along the edges 6, 8, 10, 12 may also be removed. Removal of the male nibs 36 at the top edge 10 is preferred at the extremity of arrays 18, such that the array is substantially flat on top. This will permit the array 18 both to look aesthetically pleasing and to completely abut an adjoining surface such as a ceiling. It also permits a frame to be installed around the array's 18 outer perimeter to provide a cleaner appearance. Male nibs 36 at other extremities may also be removed by the installer, if so inclined.

Figure 9:
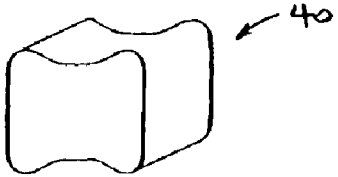
FIG. 9 depicts a perspective view of a registration and/or connection nib in accordance with the present invention.

FIG. 9 depicts a disjoined nib 40 constructed as a separate piece apart from the panel 2. The disjoined nib 40 shown is in the shape of a bowtie. This disjoined nib 40, as well as others functioning in the same manner, may also be utilized. While this type of nib 40 requires the installer to handle a multitude of smaller pieces which may be lost or misplaced, it does permit the panels to be constructed with only female recesses 38. Female recesses 38 are typically less likely to be damaged than male nibs 36. Therefore, for particular applications, disjoined nibs 40 may be preferred. Applications where disjoined nibs 40 are especially preferred include situations where professional installers will be providing and installing the panels 2, such as in commercial settings.

Figure 10:
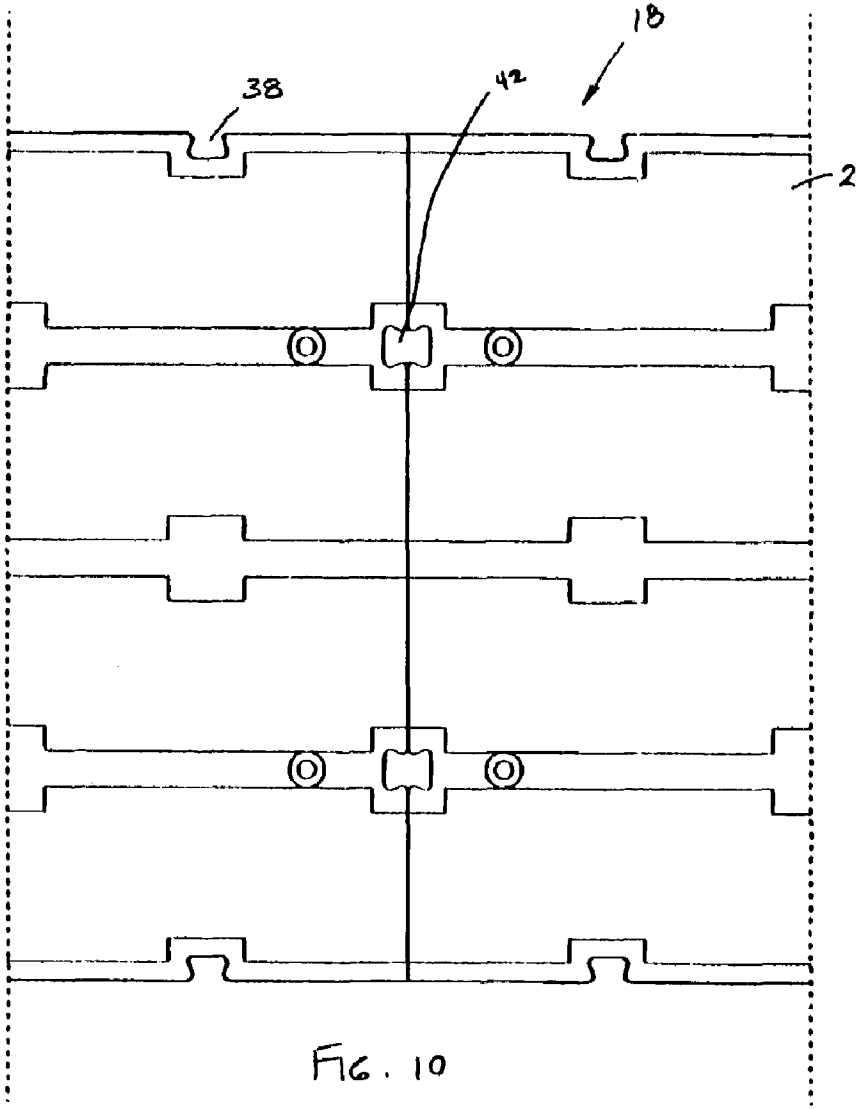
FIG. 10 depicts a pair of wall panels aligned adjacent to each other.

FIG. 10 depicts a partial array 18 of panels 2 provided with abutting female recesses 38. The abutting female recesses 38 combine to form a cavity 42 into which the disjoined nib 40 may be inserted. Because of the shape of the cavity 42 and the disjoined nib 40, the panels 2 will become locked together upon insertion of the disjoined nib 40 panels 2 will be locked in two directions. Other shapes may only lock the panels in a single direction.

Figure 11B:
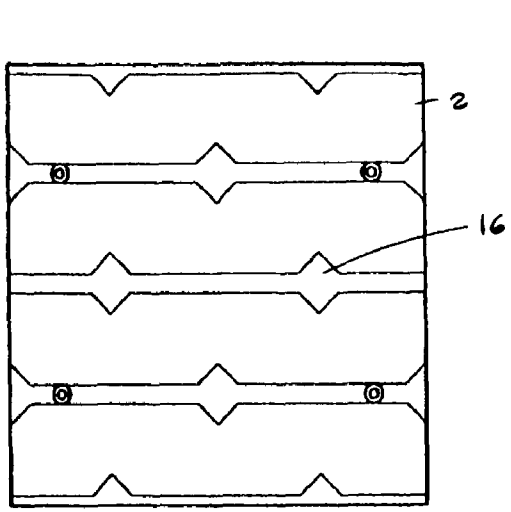
FIG. 11B depicts a frontal plan view of a wall panel in accordance with the present invention depicting diamond shaped openings.
Figure 11A:
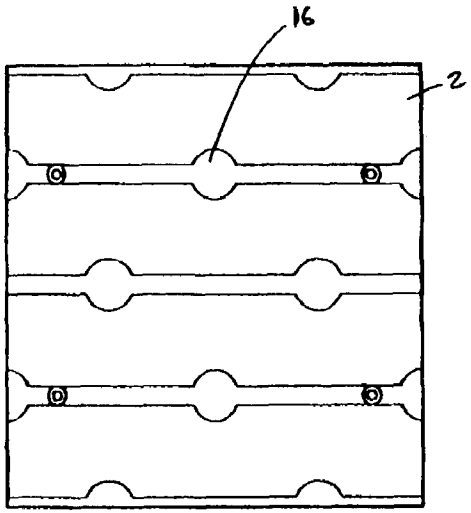
FIG. 11A depicts a frontal plan view of a wall panel in accordance with the present invention depicting circular shaped openings.
Figure 11C:
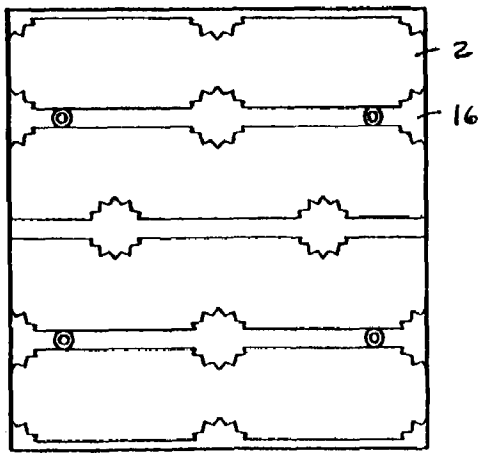
FIG. 11C depicts a frontal plan view of a wall panel in accordance with the present invention depicting star shaped openings.

It will be appreciated that the shaped openings 16 are merely enlarged openings within the slots 14 of the slatted wall panel 2. As previously discussed, the shaped openings 16 may be of a multitude of configurations. While the shaped openings 16 of the previous figures were all squares, the shaped openings of FIG. 11*a* are depicted as circles. Circles may be beneficial for particular applications, for desired appearances or for particular manufacturing needs, as will be discussed hereinafter. Other shapes may clearly be used. Examples of diamond shaped openings 16 are shown in FIG. 11*b*. Star shaped openings 16 are shown in FIG. 11*c*.

Specific icons may also be used. These icons may include corporate logos or regularly identifiable images as discussed above.

It will be appreciated however, that no matter the configuration of the shaped openings 16, a cross sectional view of the slotted sections can be substantially similar. For example, the cross sectional view of a slatted wall panel 2 with the circular shaped openings 16 may appear substantially similar to the cross sectional view of a slatted wall panel 2 constructed with square openings, or star shaped openings. This is true so long as the upper and lower extremities of the openings 16 are separated by equal distances. This dimension may vary in accordance with the particular design of the slatted wall panel 2.

Figure 12:
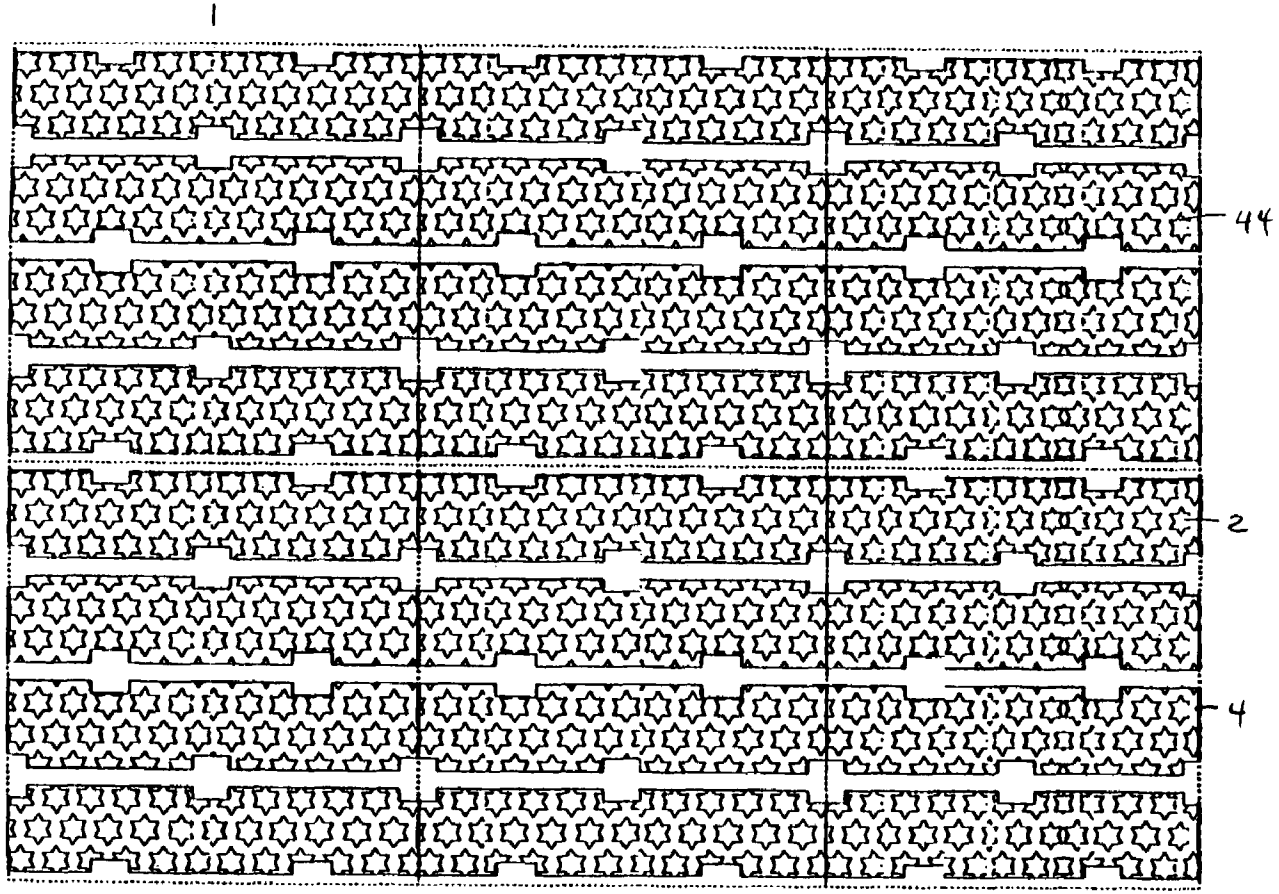
FIG. 12 depicts a frontal plan view of an array of wall panels in accordance with another embodiment of the present invention.

The slatted wall panels 2 may also be provided with decorative surface patterns 44 such as the pattern shown in FIG. 12. These patterns may be painted, embossed, engraved, or otherwise created. They may also be inlaid into a channel formed on a slat 15 (FIG. 1). The decorative surface patterns may be such that a decorative design is formed together with the shaped openings on the front surface 4 of the slated wall panel 2. Such inlays may be non-permanent and interchangeable for decorative or functional purposes.

The slatted wall panels 2 and components of this invention may be constructed from any suitable material. Preferably, slatted wall panels will be constructed of wood, plastic or medium density fiber board (MDF). Other materials such as various metals and composites may also be utilized. Combinations of these materials may also be used.

The slatted wall panels 2 may be molded into their final condition in a mold, or cast or extruded as a single piece and then processed into the final condition. The wall panels 2 may also be constructed from multiple pieces.

Figure 14:
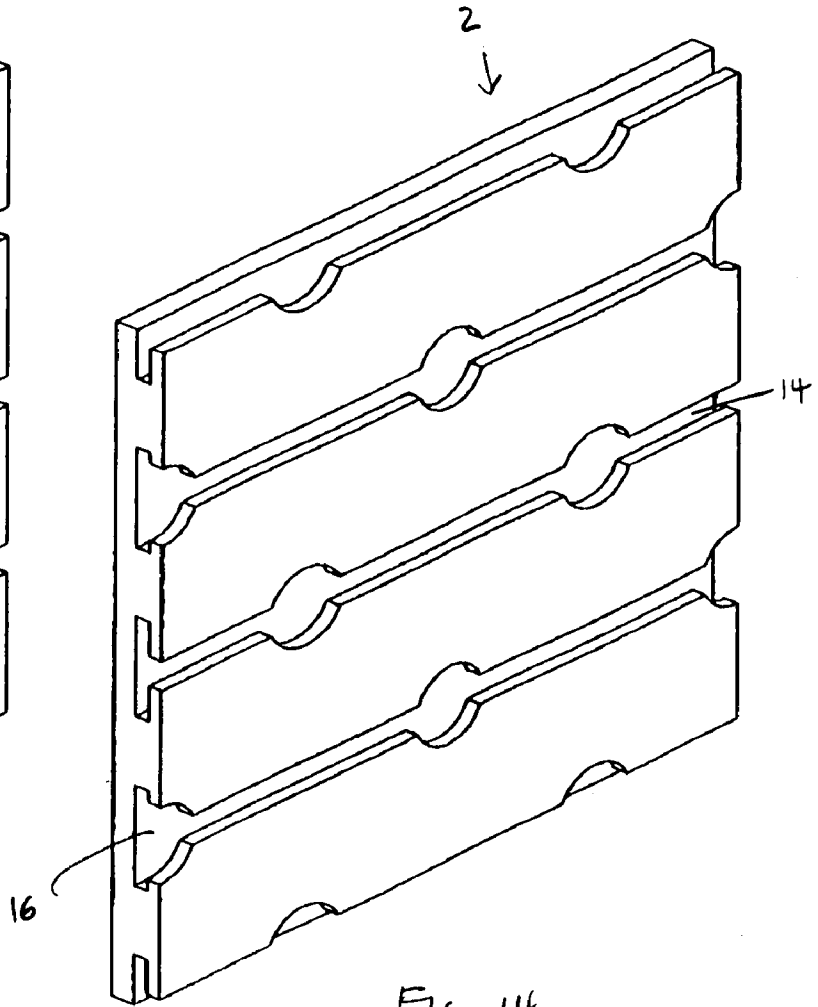
FIG. 14 depicts a second step of the method shown in FIG. 13.
Figure 13:
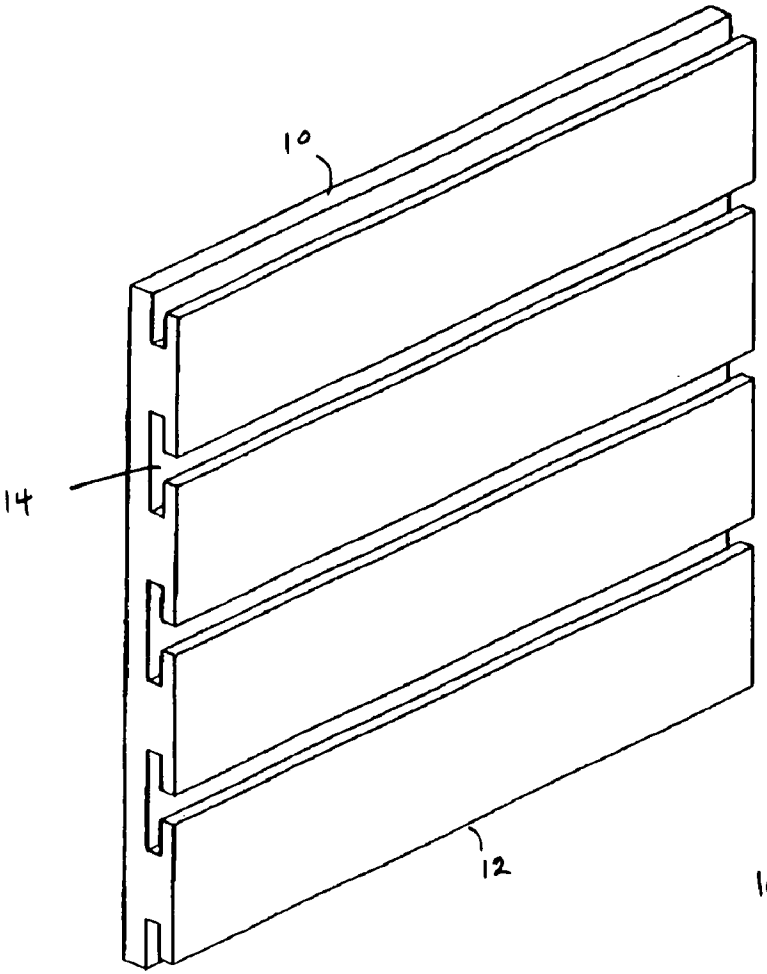
FIG. 13 illustrates the first step of a method of creating wall panels in accordance with the present invention.

FIGS. 13 and 14 depict a method of forming slatted wall panels from solid material by first milling and then drilling a solid board. Preferably, this board will be either MDF, plastic, or aluminum. As shown in FIG. 13, in one embodiment, a solid board may be milled to form a plurality of recessed T-slots 14 in the interior portion of the board and partial recessed T-slots on the exterior edges 10, 12 of the board. These T-slots represent the slotted openings 14 of the slatted wall panel 2.

The shaped openings 16 may then be formed in a second step. These openings will typically be formed by drilling locations of the T-slots 14 at periodic intervals. FIG. 14 depicts a slatted wall panel 2 in a fully completed condition following step 2.

It will be appreciated that the drilling method may result in circular shaped openings 16 as shown in FIG. 14. Such circles, as well as other shapes, may be formed by using a laser cutter, water cutter, router, or stamping press. This entire procedure may be conducted by computer numerical control (CNC). Of course, it may also be conducted through conventional non-digitized mass production techniques, or manually.

Figure 16:
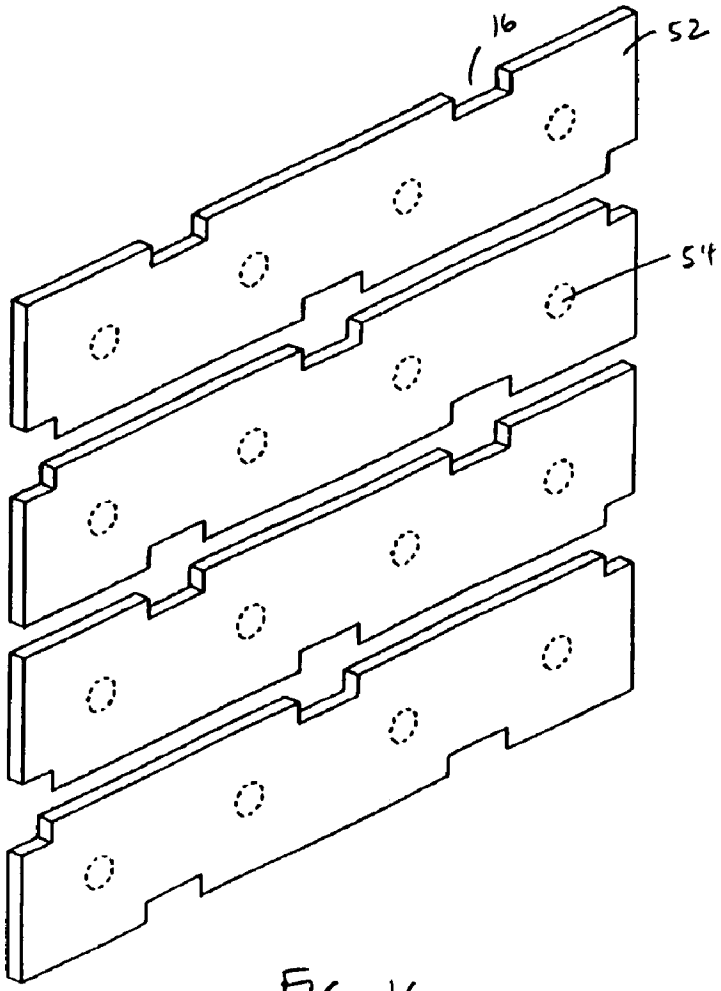
FIG. 16 depicts a second step of the method shown in FIG. 15.
Figure 15:
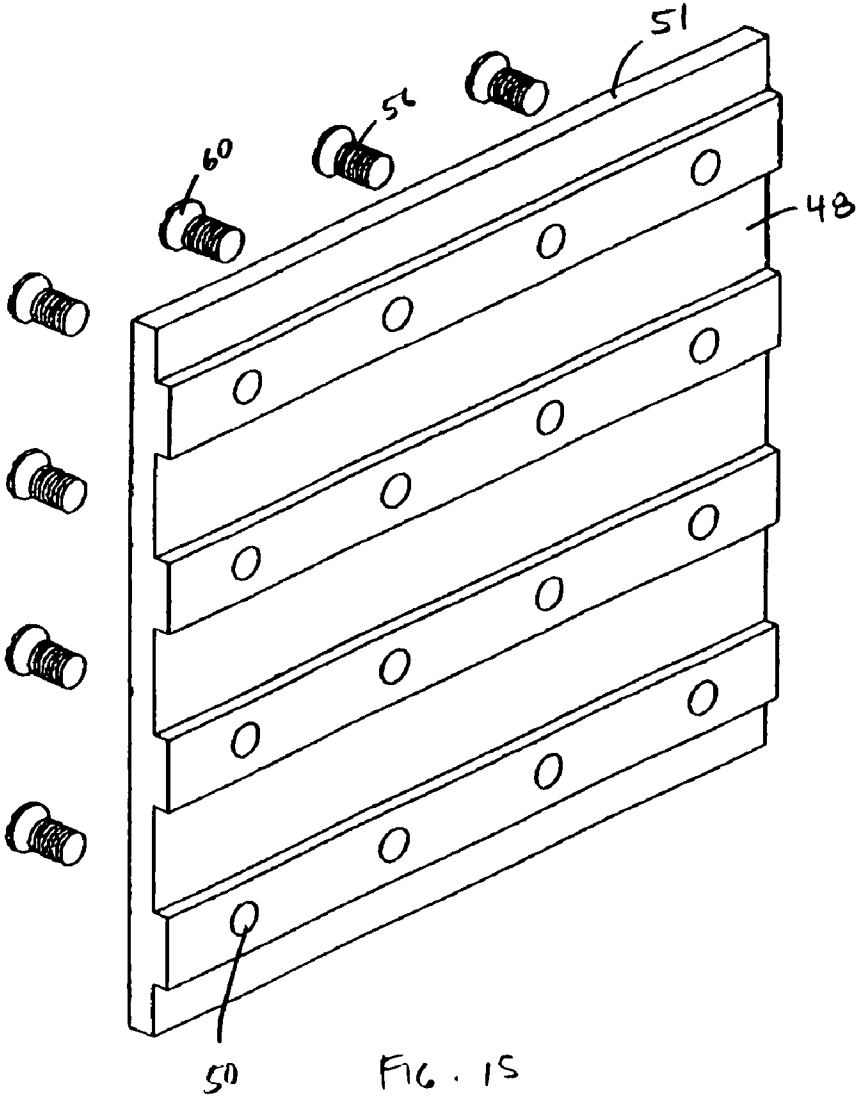
FIG. 15 depicts the first step of another method of constructing wall panels in accordance with the present invention.

FIGS. 15 and 16 illustrate another method of creating the slatted wall panels 2 of the present invention. In this method, the portion of the slatted wall panel 2 shown in FIG. 15 begins as a solid piece of material, such as MDF. The material may then be milled to form the slots 48 shown in FIG. 15 and drilled or tapped to form the holes 50 shown. The finished result is a backing plate 51 with milled slots 48 and holes 50.

Facing strips 52, as shown in FIG. 16, may then be attached. Facing strips 52 may be constructed of a variety of materials including metal, plastic, wood or composites, among others. The facing strips 52 may be formed by either casting the shapes shown in FIG. 16, or by other conventional methods. If cast, the strips 52 will be formed complete, including shaped openings 16 and holes 54. Other methods include stacking a plurality of facing strips 52 front to back. The plurality of facing strips 52 may then be milled consecutively in one continuous motion perpendicular to their length to create the shaped openings 16. Still further methods include stamping the material using a press. The facing strip 52 may then be drilled to form the holes 54 shown. Once the facing strip 52 shown in FIG. 16 and the backing plate 51 shown in FIG. 15 are complete, they may be attached to each other using mechanical fastening means 56, such as the bolts shown, screws, rivets, or the like.

Preferably, the holes 54 on the face strips 52 will be tapped holes which bolts may engage. When used with tapped holes 54, the bolt 56 will engage the tapped threads such that it is sufficiently secure without use of a bolt. Various forms of thread locking or bolt retaining compounds may also be utilized to prevent the bolt from backing out. In applications utilizing untapped holes, the bolts 56 may protrude through the face strip 52 such that a nut may be used to retain the bolt. Alternatively, the fastener 56 may be inserted from the front of the facing strip 58, such that the head 60 may be flush with the facing strip. In this case, the holes 50 shown in FIG. 15 may be tapped to receive the fastener 56. Other fastening means may also be utilized, including chemical means.

Figure 18:
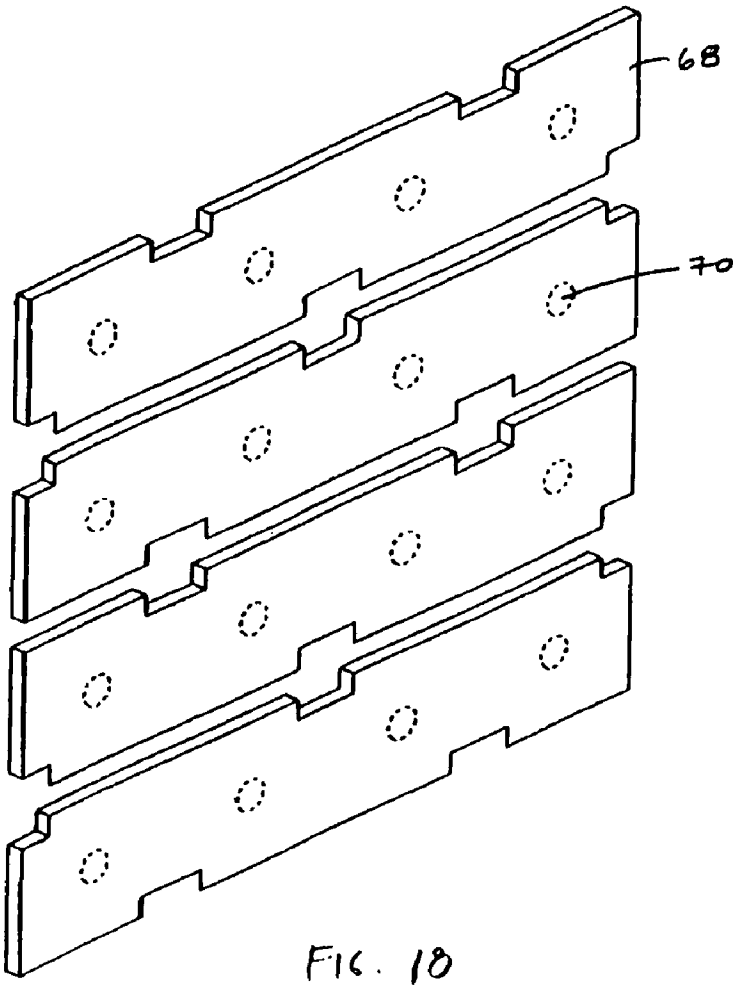
FIG. 18 depicts a second step of the method shown in FIG. 17.
Figure 17:
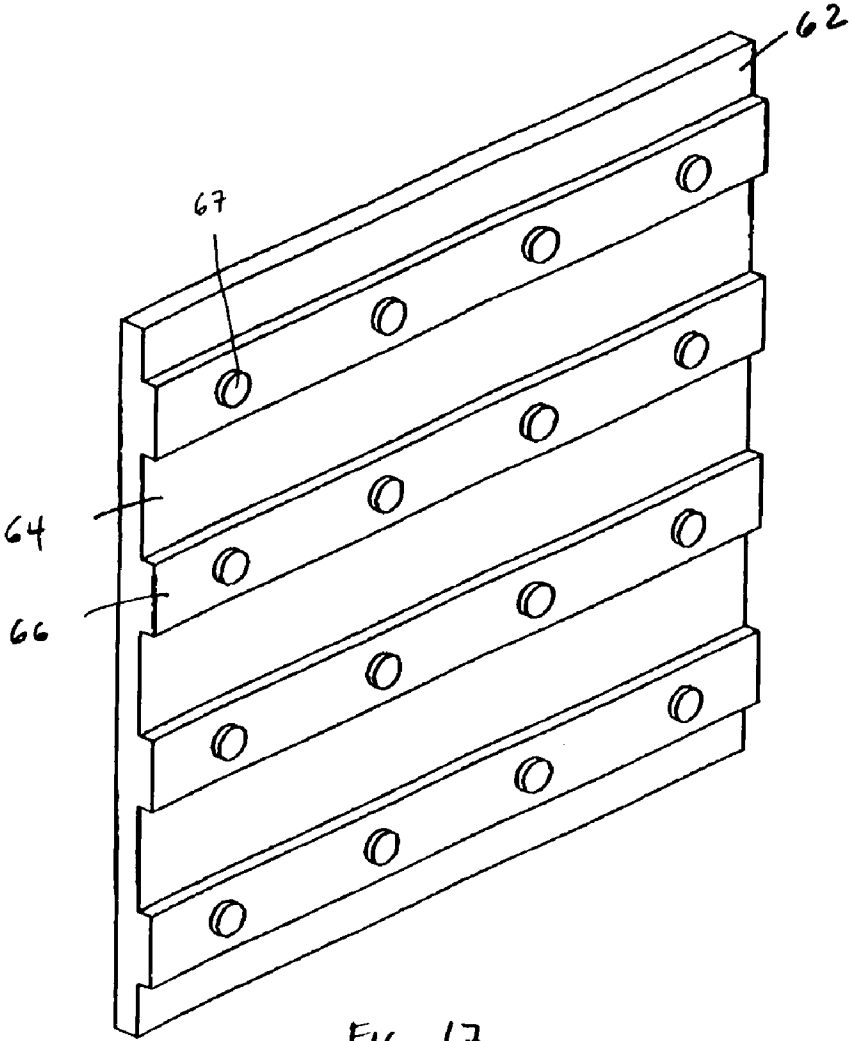
FIG. 17 depicts a first step of another method of constructing a wall panel in accordance with the present invention.

FIGS. 17 and 18 depict the steps that might be utilized when creating a slatted wall panel 2 from injected molded plastic or other similar material. First, a backing plate 62 such as is shown in FIG. 17 is molded. This backing plate 62 includes recessed slots 64 forming slats 66 therebetween. Each of the slats 66 includes protruding members 67 utilized to attach face plates 68, as shown in FIG. 18.

The faceplates 68 of FIG. 18 will preferably be molded into their final condition shown in the figure. These faceplates 68 include holes 70 in registration with the protruding members 67 such that the faceplates 68 may be attached to the backing plate 62. Preferably, the protruding members 67 and the holes 70 simply attach in a pressure fitting. If additional support is required, the pieces 68, 70 may also be chemically bonded or otherwise mechanically attached together. Of course, the protrusions 67 may be of different shapes than the cylinders depicted in FIG. 17, and may be configured to permit non-permanent or permanent affixing.

Figure 19:
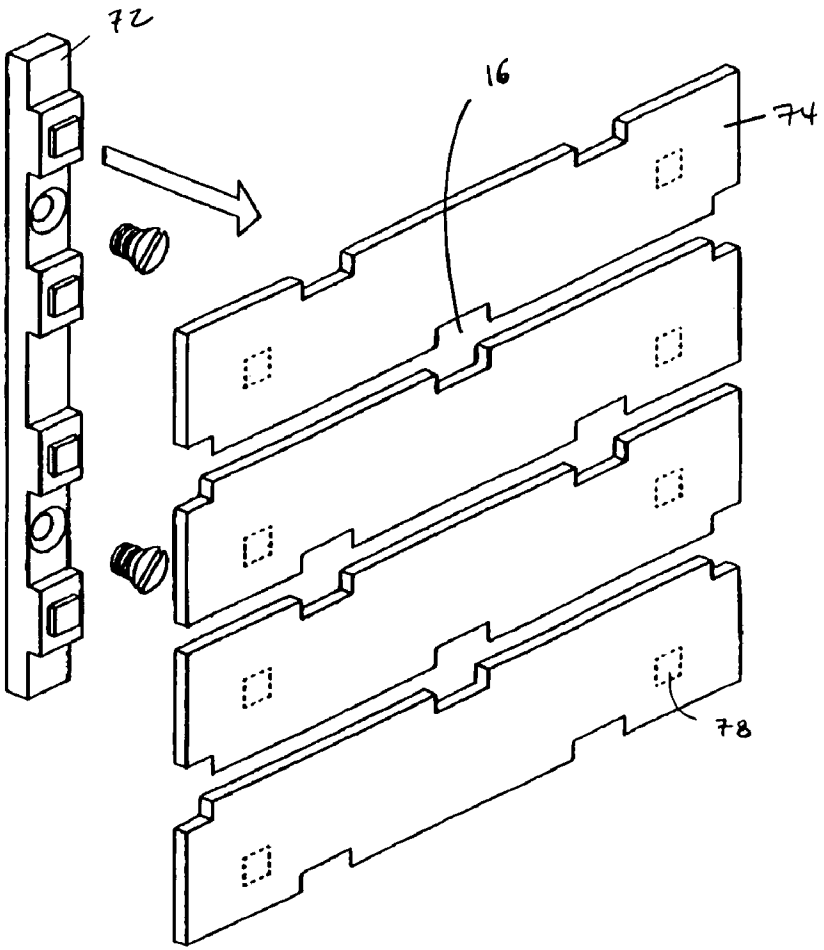
FIG. 19 depicts another method of constructing wall panels in accordance with the present invention.
Figure 19:
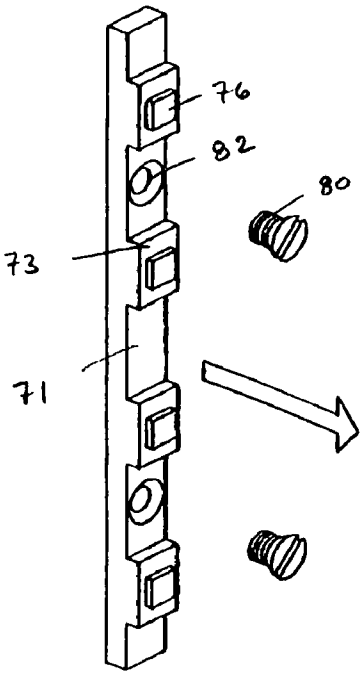
Figure 20:
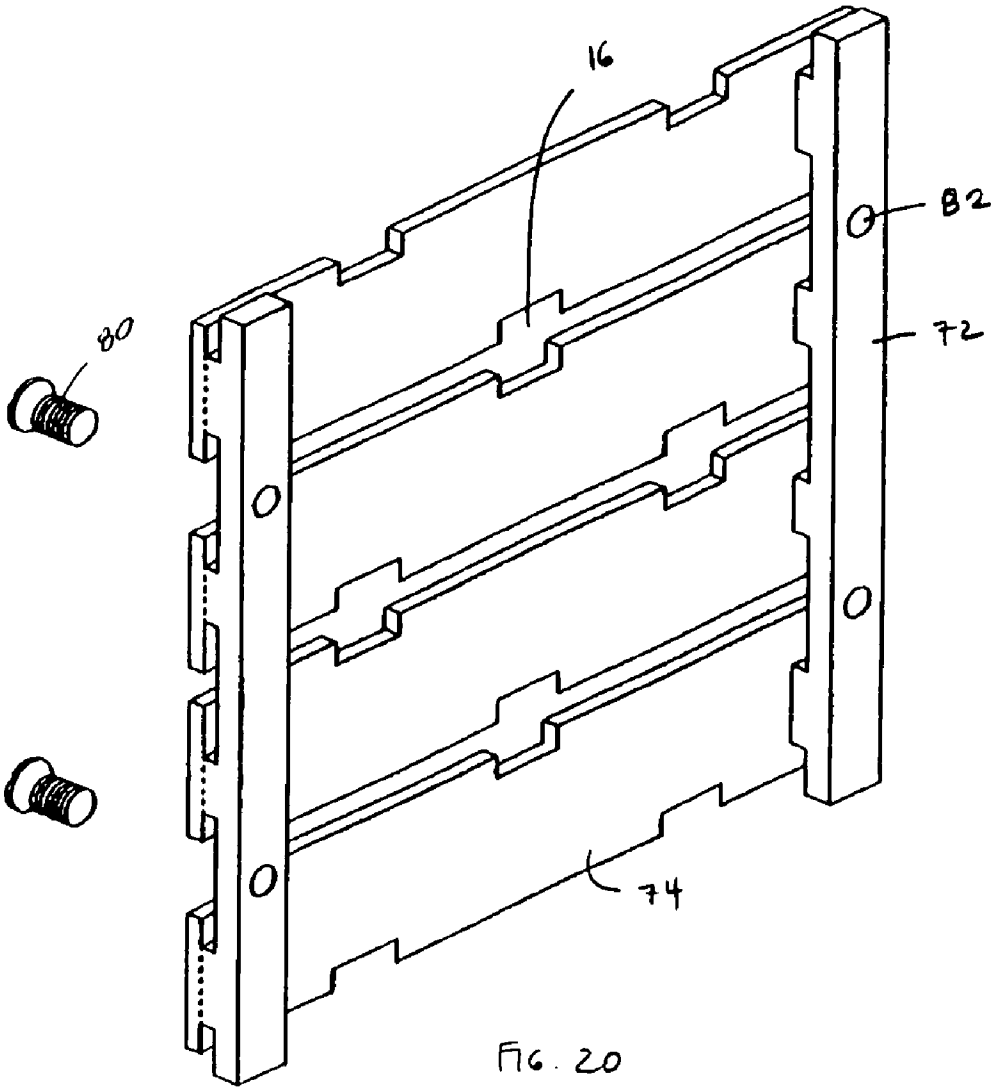
FIG. 20 depicts a rear perspective view of the method shown in FIG. 19.

FIG. 19 depicts a front perspective view and FIG. 20 illustrates a rear perspective view of another method of creating slatted wall panel 2 in accordance with the present invention. This method is designed to be utilized when a light weight panel is desired or cost is of particular concern. Notwithstanding, it may also be utilized for other reasons, including aesthetic reasons. As shown most clearly in FIG. 19, this method includes providing two backing strips 72 per panel 2. The backing strips 72 each include slots 71 forming slats 73. Formed on each slat 73 is a protruding member 76. The two backing strips 72 may be spaced such that faceplates 74, similar to those previously discussed, may be installed therebetween. The faceplates 74 may be installed in a pressure fit by utilizing protruding members 76 located on the backing strips 72 and holes 78 on the faceplates in registration with the protruding members. If additional support beyond that of this pressure fitting is required, the pieces 72, 74 may also be chemically bonded (by adhesives, coadhesives or the like) or otherwise mechanically attached together by any suitable fastener. The entire panel may be attached to a wall mechanically or chemically through holes 82 provided within the backing strips 72. Bolts 80 may be used as shown.

Existing slat wall which has already been installed may be retrofitted to permit use of the accessories of the present invention. Preferably, a jig 102 is used to facilitate such retrofitting. The jig 102 may be set up to create shaped openings 16 of a variety of configurations, such as those previously discussed including, circles, squares and the like.

Figure 21:
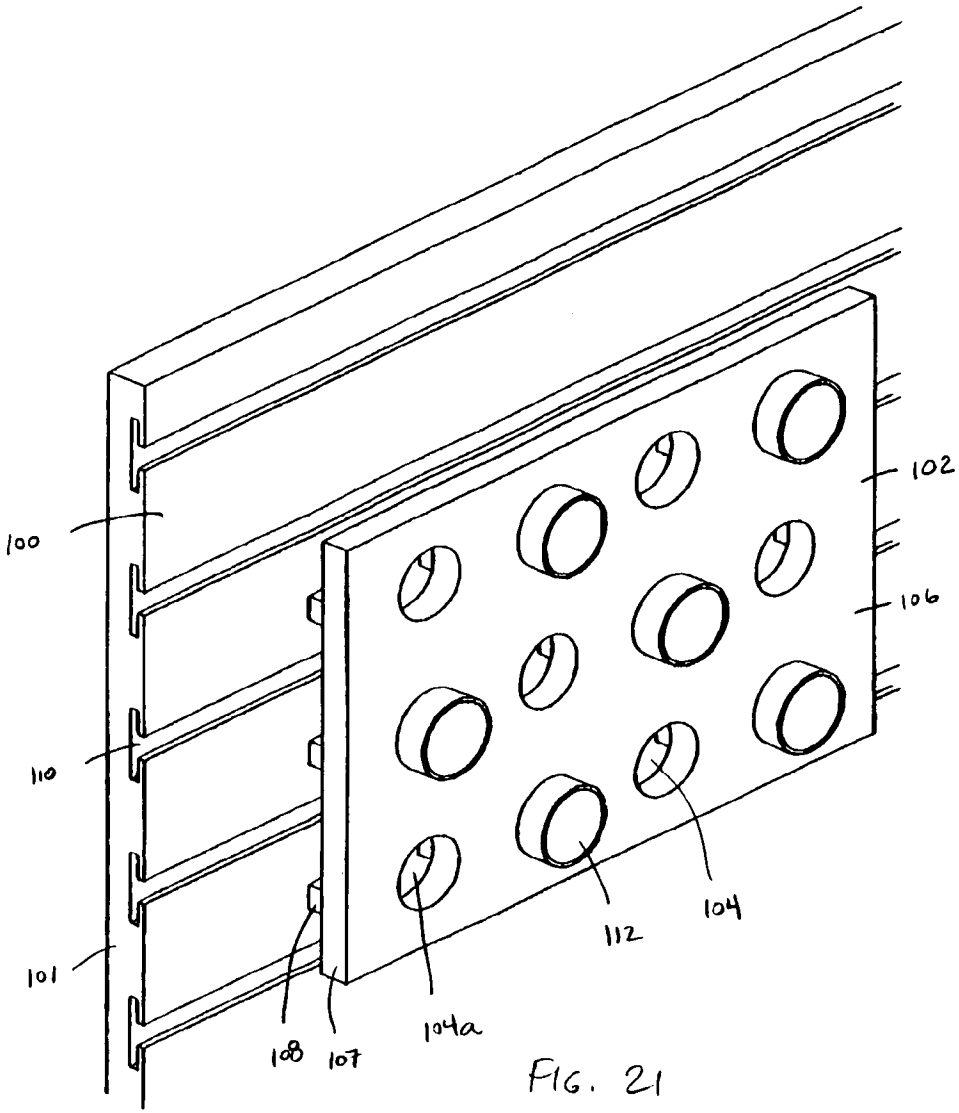
FIG. 21 depicts a method of altering conventional wall panels in accordance with the present invention.

FIG. 21 depicts a jig 102 for such purpose. As shown, a jig 102 may be constructed as a substantially planar board 106. The jig 102 further comprises a plurality of jig holes 104 extending through the board 106 and at least one rail 108. The jig 102 may be constructed as a guide to assist with the formation of shaped openings 16 within the existing slat wall 100. The jig 102 may also have other connection devices similar or identical to those provided on accessories for conventional slat wall, thus providing support and/or registration for the jig. The jig could have, for instance, a connection member that is "L-shaped" in cross-section, just as the connection member is on brackets used for conventional slat walls.

The size of the jig 102, including the rails 108 and the jig holes 104, must be customized for each type of existing slat wall 100 as well as for the accessories to be provided. Once in place, the jig 102 may be slid along the existing slots 110 in the slat wall 100 to make shaped openings 16 in the existing slots 110 that may then accommodate accessories of the present invention.

Generally, the rails 108 running along the rear of the jig 102 will be inserted into the recessed slots 110 of the existing slat wall 100. This provides vertical orientation for the jig 102 if the slots 110 of the existing slat wall 100 are running in their customary horizontal fashion. Horizontal orientation may be provided by using the jig holes 104, as will be discussed hereinafter. Once the rail 108 of the jig 102 is aligned into a recessed slot 110 of the existing slat wall 100, one edge 107 of the jig 102 may be aligned with one edge 101 of the slat wall 100. Shaped openings 16 may then be created in the existing slat wall 100 by inserting a drill with an appropriate sized bit or hole saw attachment, or a router bit, such as a plunge router bit of appropriate diameter, into the drill guides 112 provided on the jig 102. Once all of the shaped openings 16 beneath each drill guide 112 have been formed, the jig 102 may be shifted horizontally along the slat wall 100 such that the last jig hole 104 on the jig is aligned with the last shaped opening 16 created by the user. This will insure that the jig 102 is aligned for the next series of shaped openings 16 such that a continuously repeating pattern is created.

Figure 23:
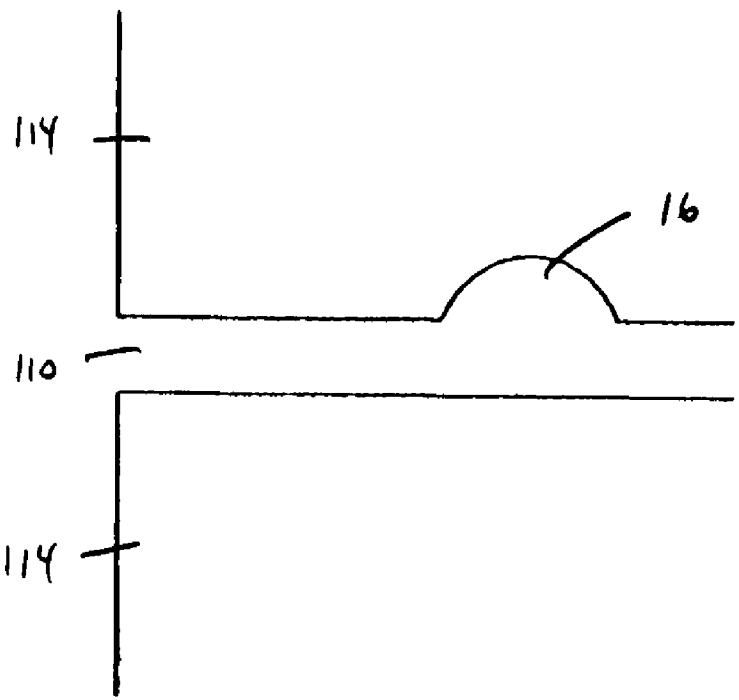
FIG. 23 depicts a shaped opening in accordance with another embodiment of the present invention.
Figure 22:
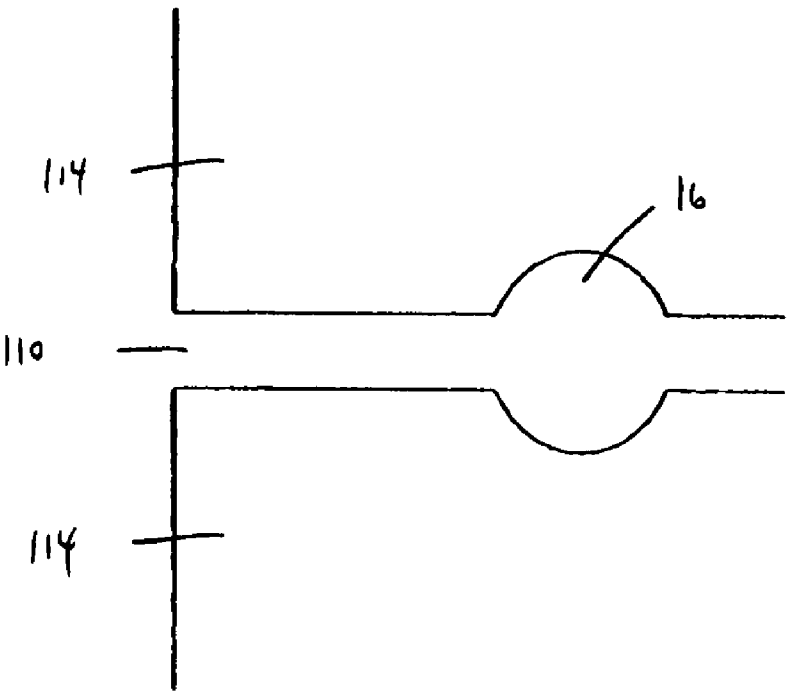
FIG. 22 depicts a shaped opening in accordance with one embodiment of the present invention.

It will be appreciated that the drill guide 112 may extend over the slot 110 such that the drill guide is centered over the slot. This will create a circular shaped opening 16 centered over the slot 110 as shown in FIG. 22. In this case, the slat 114 above and the slat below the drill guide will be cut by the hole saw or drill/router bit in substantially equal amounts. The drill guide may also be skewed over a portion of the slot 110 such that the shaped opening 16 will only be formed in one slat 114, and not in the slat also in communication with the slot where the shaped opening is formed. An example of a shaped opening formed using this technique is shown in FIG. 23.

Existing slat wall 100 which has been manufactured but not installed may also be adapted to receive the accessories of the present invention. One method includes drilling or routing using a jig 102 as previously discussed. Alternatively, conventional slat wall 100 may be retrofitted in a shop by using any of the above expedients, or preferably using a laser or other cutter to cut shaped openings 16 using CNC or manual controls. Other methods similar to those used to form the slat wall 100 may also be used.

Figure 24:
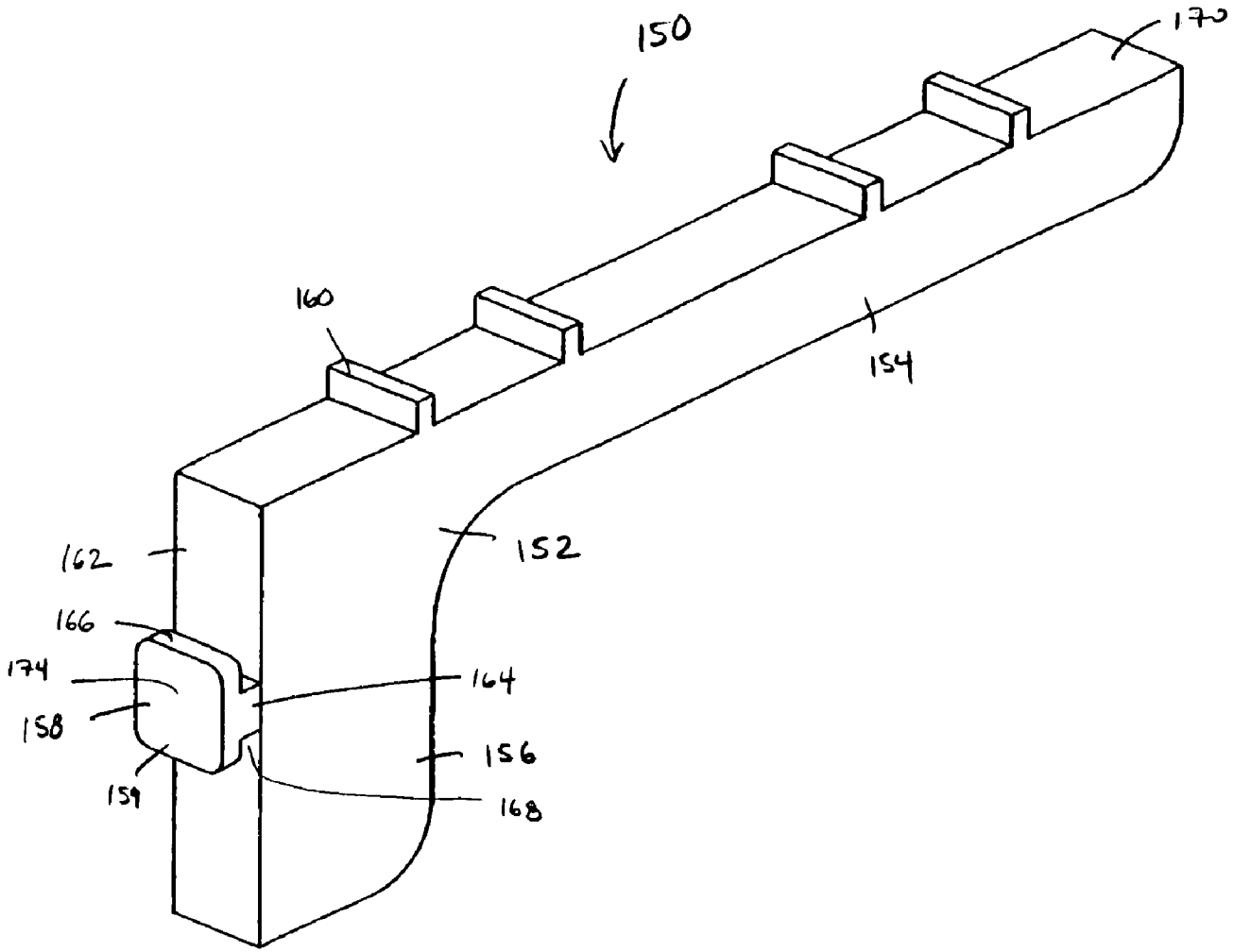
FIG. 24 depicts a bracket in accordance with one embodiment of the present invention.

A variety of accessories may be attached to the slatted wall panel of the present invention. One such accessory is a bracket 150. A typical bracket 150 is shown in FIG. 24. As shown in FIG. 24, the main member 152 of the bracket is typically L-shaped. The bracket may also be formed as a solid triangle, open triangle, or an infinite multitude of other configurations.

Typically, this L-shaped main member 152 is formed from two sections, with each of the two sections being perpendicular to each other. The first section 154 is a shelf support while the other is a wall support 156. When installed, the rear surface 162 of the wall support is placed adjacent to the front surface 4 of the wall panel 2.

Extending off of the rear surface 162 of the wall support is a shaped member 158. Preferably, the shaped member is a "T-shaped" member. In this and in other embodiments, the shaped member need not be "T-shaped." Rather, it can be of any suitable shape having a portion that will be received in any undercut in the wall panel in order to provide the requisite support. For instance, an L-shape may be utilized. Also, in plan view, the member 158 is square, but can be of any suitable shape that fits into a shaped opening in a panel. The shape of the member and the shape of the opening need not match. Finally, it will be appreciated that the recessed slots 14, although shown in a T-configuration, may also be provided in other forms. One such form is an L-shaped slotted opening. If so provided, the shaped openings will typically be skewed to one slat 15, such as is shown in FIG. 23.

The T-shaped member 158 in FIG. 24 comprises a first extension 164 extending from the rear surface 162 of the wall support section 156. A shaped piece 166 is attached to the first extension 164 such that a gap 168 is formed between the shaped piece 166 and the rear surface 162 of the wall support section 156.

Protruding from the upper surface 170 of the shelf support section 154 are shelf guides 160. As will be discussed, the shelf guides 160 are utilized to secure a shelf 172 (FIG. 25) upon the upper surface 170 of the shelf support section 154.

The bracket 150 may be attached to the slated wall panel 2 of the present invention in one of two ways. The T-shaped member 158 may be slid into any of the undercuts and recessed slots 14 (as shown in FIGS. 1, 4 or 6) from an edge 6, 8 of slatted wall panel 2. It may also be slide into an edge 22 of an array 18 of slated wall panels 2 (as shown in FIG. 2). This technique is similar to one technique used to add accessories to existing slat wall designs known in the prior art. To assist with this type of installation, it will be appreciated that the slots 14 of the slated wall panel 2 are slightly larger than the T-shaped member 158 of the bracket 150. These tolerances are ideally such that the T-shaped member 158 is free to slide along the slot 14, but not so loose that rotational stability is compromised.

Another method of connecting the bracket 150 to the slatted wall panel 2 is by inserting the T-shaped member 158 into one of the shaped openings 16 along the front surface 4 of the slatted wall panel and then sliding it along the slot 14 into a position in which it may no longer be pulled from the slatted wall panel but remains free to slide within the slot. In this regard, the T-shaped member 158 can be inserted perpendicular to the front surface 4 of the wall. Preferably, the wall support section 156 of the bracket 150 is perpendicular to the slots 14. No tilting of the bracket is required. This novel technique is referred to as the "plug and slide" technique.

Referring to FIG. 24, it is shown that the distal end 159 of the T-shaped member 158 may have a front surface 174 forming the shape of a square. This front surface 174 is preferably coordinated with the shape of the shaped openings 16 of the slatted wall 2. Thus, if the slatted wall 2 is fitted with circular shaped openings 16, the T-shaped member 158 extending from the bracket 150 may be formed into the shape of a circle, rather than a square. Likewise, other configurations are possible, for example, those used with L-shaped slots 14 or square shaped openings 16 as shown in FIG. 23. It is also possible that dissimilar shapes may be used, depending on their configurations. The shaped member 158 need only fit into the shaped opening 16, and thus the matching of shapes is not a necessity.

The brackets 150 may be provided in a variety of lengths. For example, the shelf support portion 154 of the bracket 150 shown in FIG. 24 extends out perpendicular to the front surface 4 of the slatted wall panel 2 a certain distance. Meanwhile, other shelf support sections 154 may extend out shorter distances. Likewise, the wall support portion 156 of the bracket 150 may vary in length. It may also be so long as to extend beyond the next slot 14 from the one within which the T-shaped member 158 of the bracket 150 is engaged. This is merely a matter of design. If desired, such as to provide additional support, a second T-shaped member (not shown) may be included on the bracket 150 such that it will engage with a second slot 14. Typically, this engagement will not be with the adjacent slot 14, but rather the second slot away due to the staggered arrangement of the shaped openings 16 of a typical wall panel 2.

It will be appreciated that if a bracket 150 is provided with two such T-shaped members 158, the bracket will be stronger and will provide much greater rotational stability than a bracket equipped with only one T-shaped member. It will also be appreciated that other fittings may be provided in lieu of the second T-shaped member 158 in order to achieve this result. For example, a simple rail (not shown) need only be provided to insure rotational stability. This rail may, for example, fit within the slot 14 on the slatted wall panel 2 directly below the slot in which the T-shaped member 158 is engaged. It may also fit into other slots 14, such as the same slot as the original T-shaped member 158.

Figure 25:
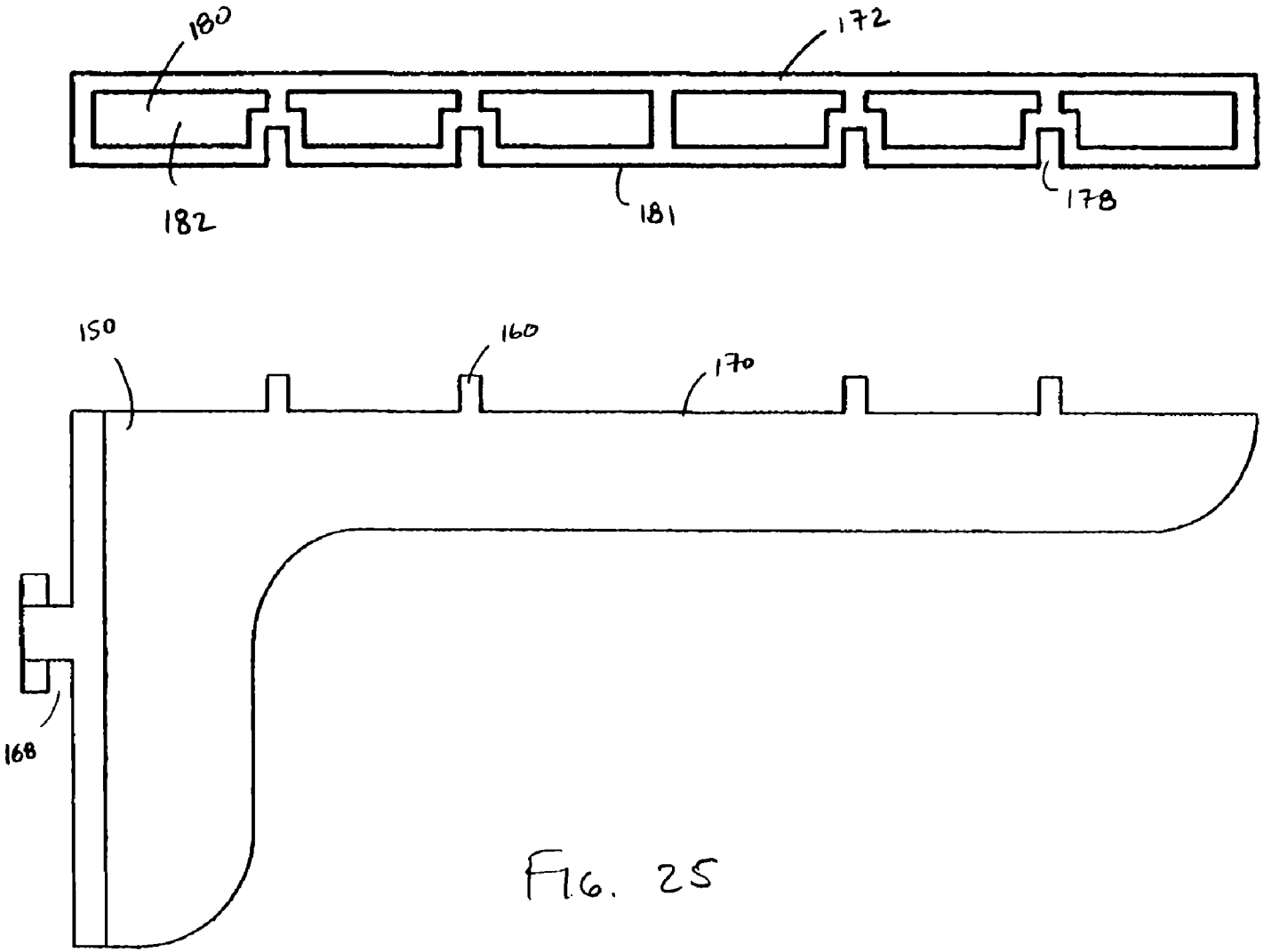
FIG. 25 depicts a bracket and shelf in accordance with one embodiment of the present invention.

FIG. 25 depicts an exploded end view of a bracket 150 and shelf 172 arrangement. The bracket 150 shown in this figure includes four shelf guides 160 extending upward from its top surface 170. As best shown in FIG. 24, the shelf guides 160 are typically rectangular protrusions. These shelf guides 160 may engage the grooves 178 in the bottom surface 181 of a shelf 172, as shown in FIG. 25. Such an engagement naturally prevents the shelf 172 from sliding perpendicular to the direction in which the shelf guides 160 are oriented. In addition, the shelf guides 160 and the grooves 178 provided in the shelf 172 may be constructed such that the tolerances between the two are very tight, such that a pressure fitting is created. These arrangements will prevent the shelf 172 from freely sliding back and forth along the front surface 4 of the slatted wall panel 2. The shelf 172 may also be glued or mechanically fastened in place.

It will be appreciated that typically two brackets 150 and one shelf 172 will be provided. To add strength or as an aesthetical consideration, additional brackets 150 may also be utilized. The shelf 172 of FIG. 25 is relatively wide and includes four grooves 178 for engagement with four shelf guides 160. Narrower shelves 172 may also be provided to serve the same function. As previously discussed, the bracket 150 may be shorter and only a single narrow shelf 172 provided. Each of these arrangements, and many others, are merely design choices based on the particular circumstances in which the shelf 172 is to be used.

Figure 26:
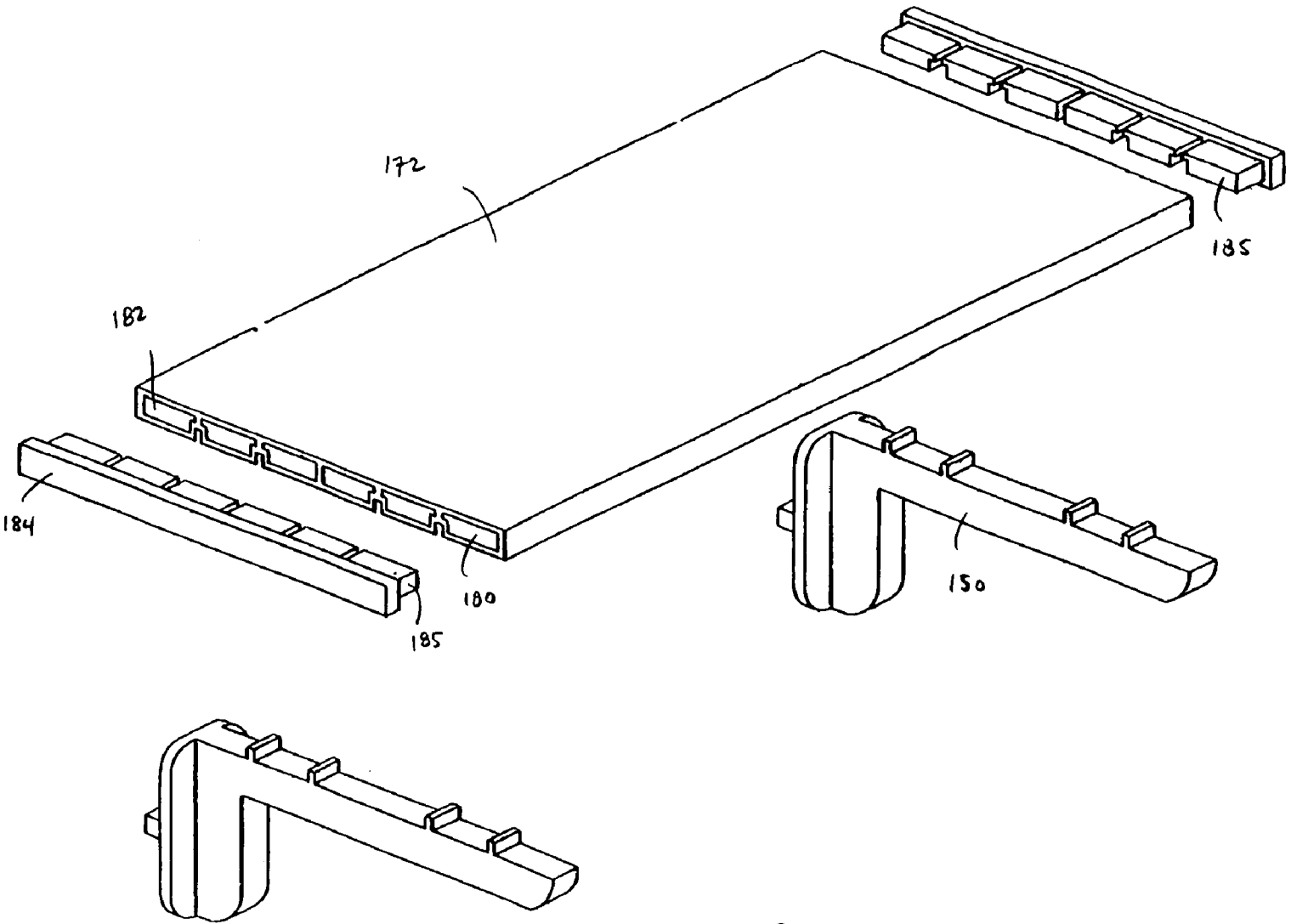
FIG. 26 depicts an exploded perspective view of brackets with a shelf in accordance with another embodiment of the present invention.

The brackets 150 and shelves 172 may be constructed from a variety of materials. Typically, those materials include woods, plastics, and metals. Various composites may also be used. The shelf may also be manufactured from solid material which is milled to form grooves 178. The shelf 172 shown in FIG. 25 has been extruded, or molded, such that a plurality of apertures 180 extend through the shelf 172 to form hollow cavities 182. As shown in FIG. 26, caps 184 may be included to cover the hollow cavities 182 to make the shelves 172 more aesthetically pleasing. Such caps 184 also serve to protect the shelves 172 when installed, or to cover imperfections created during the manufacturing or handling process. While FIG. 26 depicts an exploded perspective view of the caps 184 and shelf 172, it will be appreciated that the caps may be installed simply by inserting fitted elements 185 into the apertures 180 of the shelf 172. The fitting is typically sufficiently tight such that the cap 184 will be retained.

Although the brackets 150 and shelves 172 have been depicted with a guide 160 and groove 178 system extending along the length of the shelf, other means for attaching the shelves to the brackets have been contemplated. These include manufacturing the shelf 172 with a substantially flat bottom surface 181 and providing a bracket 150 without shelf guides 160. For example, the shelf 172 may have a flat bottom surface 181 which simply rests on the bracket's 150 upper surface 170. The bottom surface 181 of the shelf 172 may could also be milled across its width such that the bracket 150 rests within the milled portion of the shelf 172. The shelves 172 may also be glued or mechanically secured to the brackets 150.

Alternate embodiments of the bracket 150 previously described have also been contemplated. One such bracket 150 adds components designed to increase its strength and rotational stability. Brackets in accordance with the first embodiment and the second embodiment are shown in FIG. 27.

Figure 27:
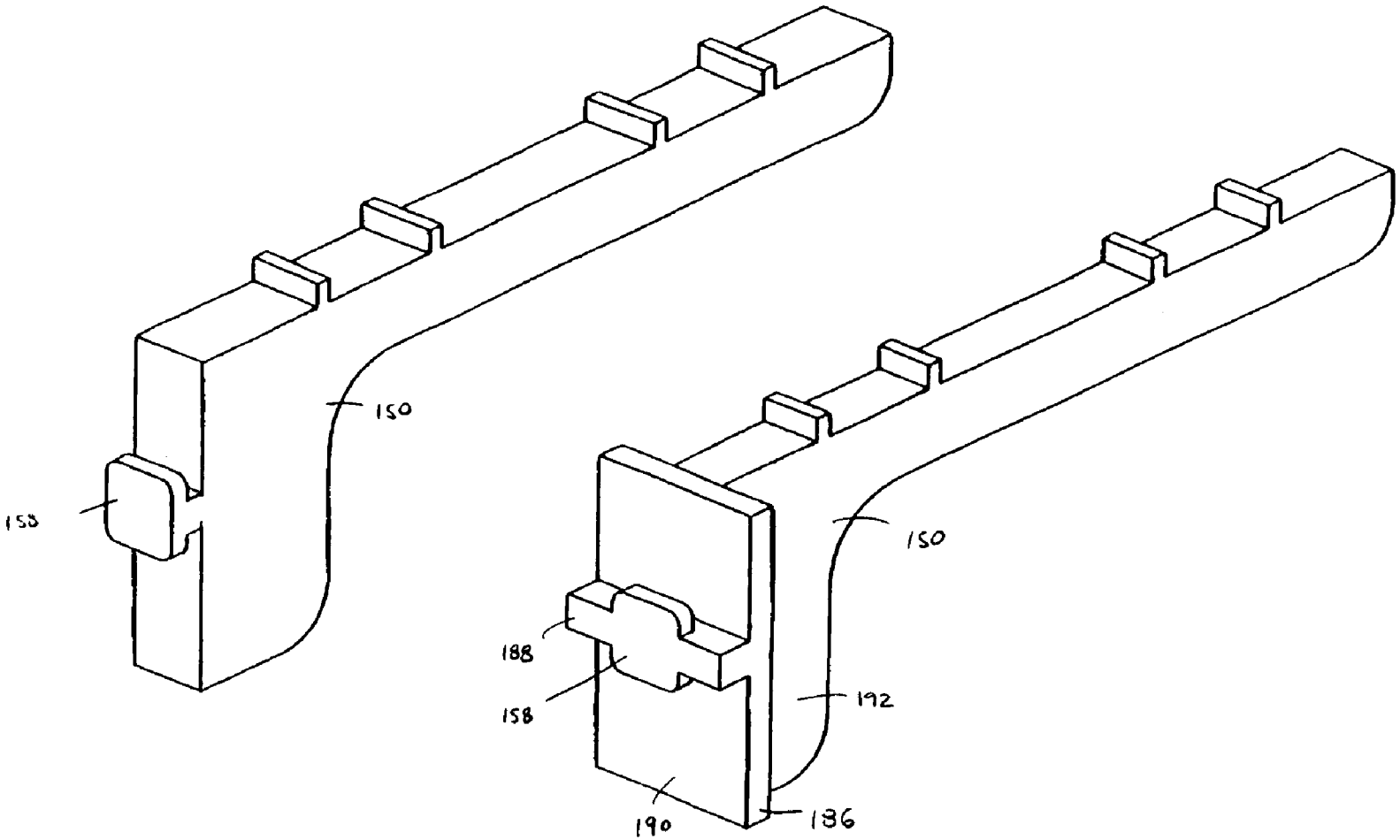
FIG. 27 depicts a perspective view of two brackets in accordance with two additional embodiments of the present invention.

As shown in FIG. 27, additional elements provided in the second embodiment include a support plate 186 and an elongated rail 188 forming a portion of the T-shaped member 158. The elongated rail 188 along the back surface 190 of the support plate 186 provides a greater engagement surface area with the slots 14 of the slatted wall panel 2. This greatly enhances the rotational stability of the bracket 150. Meanwhile, the support plate 186 provides additional bearing surface area between the bracket 150 and the front surface of the slat wall 4. The support plate 186 may be a true plate as shown in FIG. 27, or a pair of built up shoulders adjacent the side surfaces 192 of the bracket 150. This general design also serves as a starting point for more elaborate accessories for the slatted wall panel 2.

Figure 28:
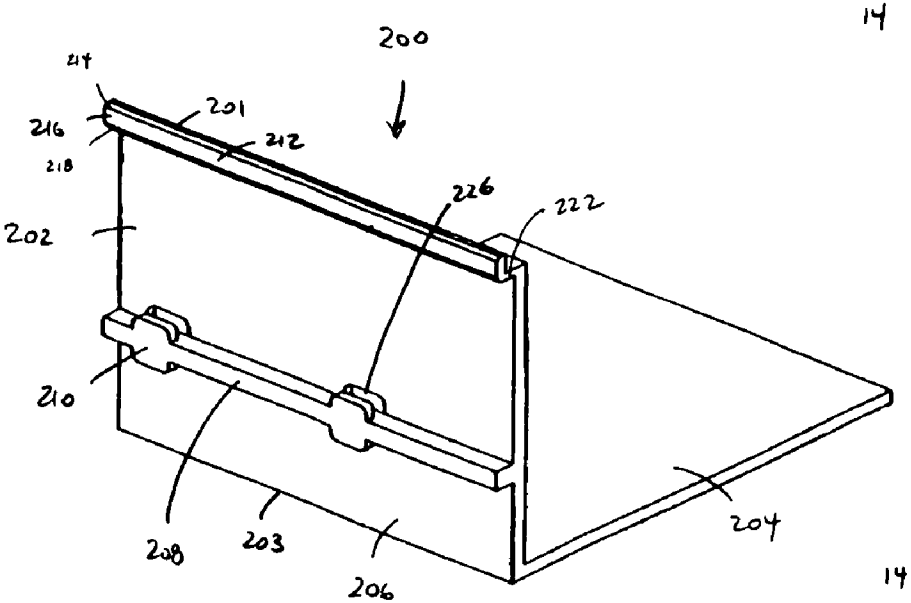
FIG. 28 depicts a perspective view of a preformed shelf in accordance with one embodiment of the present invention.

FIG. 28 illustrates one such more elaborate accessory, a preformed shelf depicted as element 200. The shelf 200 comprises a back member 202 and a shelf member 204 extending perpendicular to the back member 202. The shelf member 204 is adjacent to, and extending from, the front surface of the back member. On the rear surface 206 of the back member 202 is a rail 208 with shaped pieces 210. The shaped pieces 210 shown in FIG. 28 are squares. These shaped pieces 210 are intended to correspond to the shaped openings 16 of a slatted wall panel 2. Where two such shaped pieces 210 are provided, they will be spaced such that they are in registration with the shaped openings 16 of the slatted wall panel 2.

The back member 202 also includes an upper edge 201 and a lower edge 203. The shelf member 200 of FIG. 28 also comprises a second rail 212 at the upper edge 201 of the back member 202. It will be appreciated that the second rail 212 may be located on the lower edge 203 and still function in the same manner. The spacing of the second rail 212 from the first rail 208 is coordinated with the spacing of the recessed slots 14 of the slatted wall panel 2, as will be seen hereinafter.

Second rail 212 may run along the entire length of back member 202, as shown in FIG. 28, or may have only a limited length in one or both directions from a shaped piece. The second rail 212 comprises a rear face 216 abutting chamfered faces 214, 218. The rear face 216 is substantially parallel to rear surface 206 of back member 202. The chamfered faces 214, 218 are each angled from the rear face 216 towards back member 202, as shown in FIG. 28. Offset member 222 connects the second rail 212 to back member 202. It will be appreciated that the offset member 222 preferably has a width at least equal to the thickness of the front face 224 of the slatted wall panel 2, as shown in FIG. 29.

Figure 29:
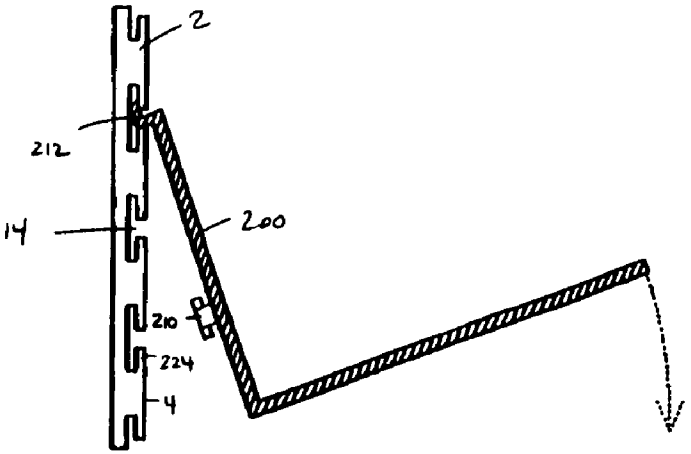
FIG. 29 depicts the first step of a method of attaching a preformed shelf in accordance with one embodiment of the present invention.
Figure 30:
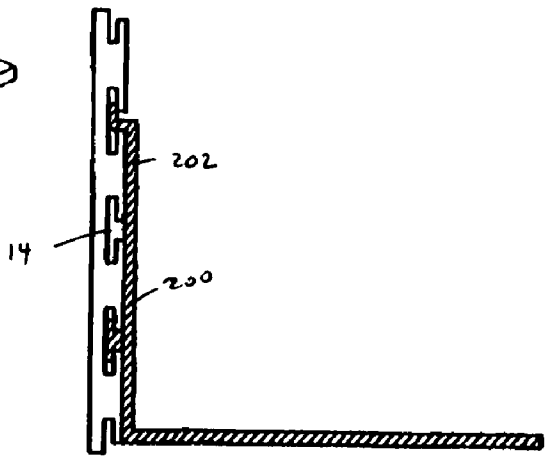
FIG. 30 depicts a second step of a method shown in FIG. 29.

FIGS. 29 and 30 depict one method of installing the preformed shelf member 200 of FIG. 28. The preformed shelf member 200 may be installed by first tilting it at an angle approximately 30° to 60° off of the axis of the front surface 4 of the slatted wall 2 and inserting the second rail 212 into a recessed slot 14 of the slatted wall panel 2. As discussed, the second rail 2 is typically chamfered. This serves to permit insertion of the shelf member 200 at this range of angles of rotation. Once the second rail 212 is inserted, the preformed shelf member 200 may be rotated towards the slatted wall panel 2 such that the shaped pieces 210 align with, and are inserted into, the shaped opening 16 of the slatted wall panel 12. Similarly, the portions of the rail 208 between and along side of the shaped pieces 210 will be inserted into the recessed slot 14 of the slatted wall panel 2. This final configuration is shown in FIG. 30. Once in this configuration, the preformed shelf 200 may be freely slid along the length of the recessed slots 14, until placed at its desired location. Alternatively, and as discussed in connection with other embodiments below, instead of a second rail 212, a shelf or other accessory can include vertically spaced shaped pieces on an accessory to fit into vertically spaced shaped openings that are aligned similarly to the vertically spaced shaped pieces. Such a construction would operate like other plug and slide accessories with substantially no tilting.

As shown in FIG. 28, the back member 202 of the preformed shelf unit 200 may include apertures 226 near and around the shaped pieces 210. The apertures 226 assist in the shelf molding and assembly process. These apertures 226 also permit a visual line of sight for the user such that she may discern the location of a shaped opening 16 on the slatted wall panel 2 to assist with insertion of the shaped pieces 210 of the preformed shelf 200. In addition, once installed and then slid to a position not in correspondence with a shaped opening 14, the user will be able to return the shaped pieces 210 of the preformed shelf 2 into registration with the shaped openings 16 of the slatted wall panel 2 in order to remove the preformed shelf 200. It will be appreciated that removal of the preformed shelf 200 may be performed by simply sliding the shaped pieces 210 of the shelf into registration with the shaped openings 16 of the slatted wall panel 2 and tilting the preformed shelf 200 to such an angle that the second rail 212 releases from the slatted wall panel 2.

Figure 31:
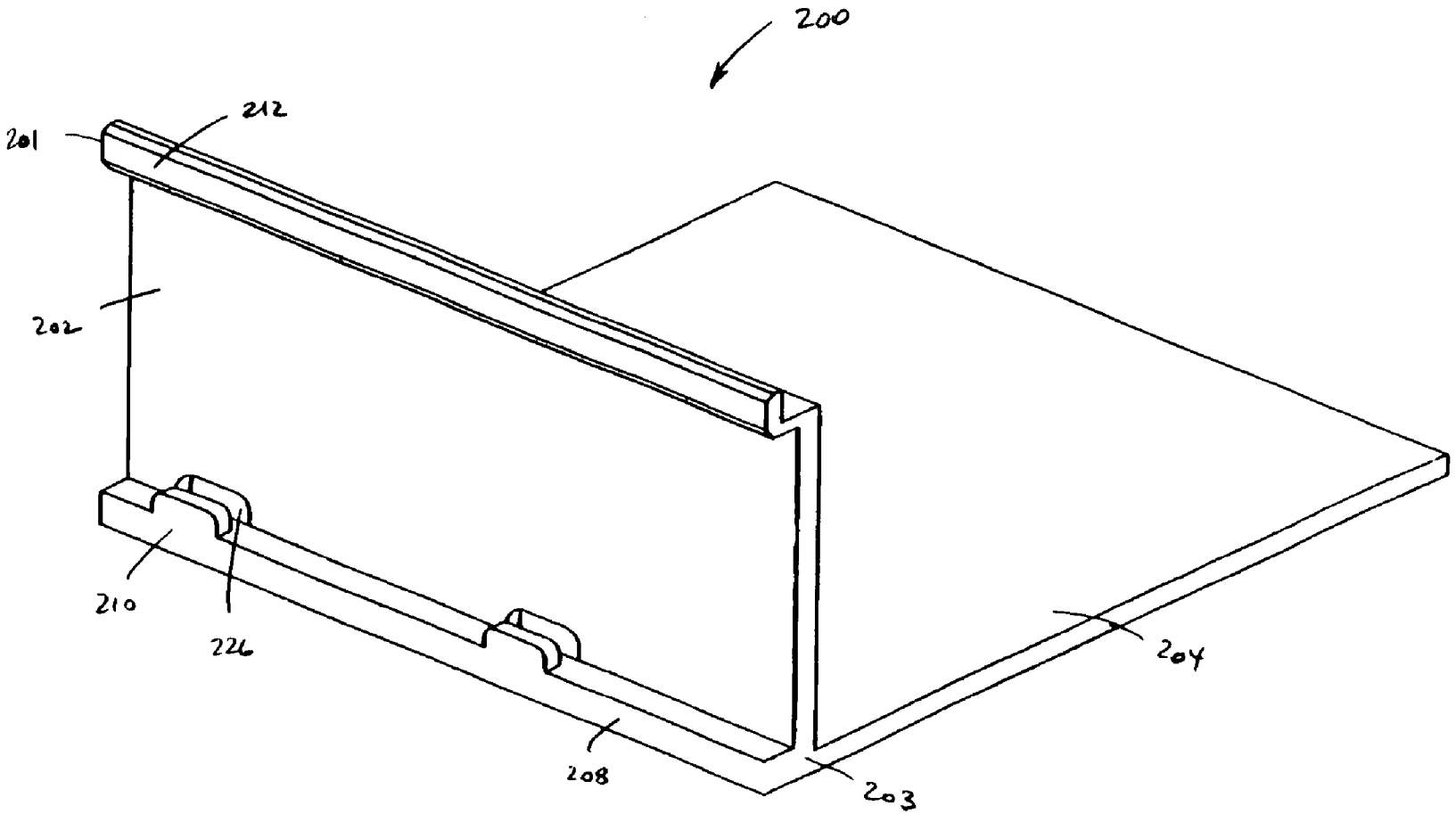
FIG. 31 depicts a perspective view of a preformed shelf in accordance with another embodiment of the present invention.

As previously discussed, the preformed shelf 200 may be constructed in alternate manners. One such embodiment is shown in FIG. 31. In this embodiment, the first rail 208 is at a location even with the level of the shelf member 204, rather than above it as previously shown. This is simply a matter of design choice. It will also be noted that the shaped pieces 210 along the first rail 208 only extend in one direction in this embodiment, rather than in two directions as shown in FIG. 28. Notwithstanding, they still function in the same manner as those of the previous embodiment.

In another embodiment of the preformed shelf 200 (not shown), the shelf member 204 is located at the upper edge 201 of the shelf 200, rather than at the lower edge 203, is in previously embodiments. The first rail 208 with shaped pieces 210 may be located at the upper edge 201 or elsewhere along the rear surface 206 of the shelf 200. The second rail 212 is located at the lower edge 203.

In this embodiment, the second rail 212 is inserted into a recessed slot 14 of the slatted wall panel 2 while the shelf 200 is tilted at an angle of approximately 30° to 60° from the front surface 4 of the slatted wall panel. Once inserted, the shelf 200 is then tilted upwards such that the shaped pieces 210 of the first rail 208 may be inserted into the shaped openings 16 of the recessed slot 14. This embodiment of the shelf 200 is not typically stable in this position as the shaped pieces 210 may freely fall from within the shaped openings 16, allowing the shelf to rotate downward. To provide stability, the shelf 200 must then be slid such that the shaped pieces 210 of the first rail 208 are no longer in registration with the shaped openings 16 of the recessed slot 14. In this position, the shelf 200 is highly stable, as it was in the other embodiments.

It will be appreciated that the shelf configuration is merely an installation preference. Such preferences may be dictated by the location of the slatted wall panel 2 in relation to other objects. For example, a shelf 200 with the shelf member 204 at the upper edge 201 of the back member 202 will typically not be installed towards the upper portion of an array 18 of slatted wall panels 2 if the panels end at a barrier such as a ceiling. Likewise, the preformed shelf 200 will usually not be installed in the position shown in FIG. 30 if the lower portion of the array 18 of slatted wall panels 2 is against a barrier such as a floor. Of course, however, there may be circumstances when such installations are desirable.

When installing the preformed shelf 200, once the second rail 212 is inserted, it is imperative that the shaped piece 210 of the first rail 208 align with the shaped opening 16 of the recessed slots 14 for the shelf to be fully installed. The apertures 226 of the back member 202 of the preformed shelf 200 permit visual observation of this alignment. For instance, the shaped piece 210 of the first rail 208 may be in partial alignment with a shaped opening 16 when the second rail 212 of the shelf 200 is first installed. If so, the shelf 200 must be shifted such that the shaped piece 210 of the first rail 208 is in full alignment with the shaped opening 16 of the recessed slot 14. Once placed in this position, the shelf 200 may be pushed completely flat against the front surface 4 of the slatted wall panel 2 where it may be slid into a fixed position.

It will be appreciated that any of the preformed shelf members 200 previously discussed may also be installed using alternate methods. One such method is to place the entire shelf adjacent to one of the side edges 6, 8 of the slatted wall panel 2. If the first and second rails 212 of the shelf 200 are in alignment with adjacent recessed slots 14, the shelf 200 may be slid into the recessed slots 14 and placed in a finished position. The shelf 200 may also be removed from the slatted wall panel 2 using a similar procedure.

Figure 33:
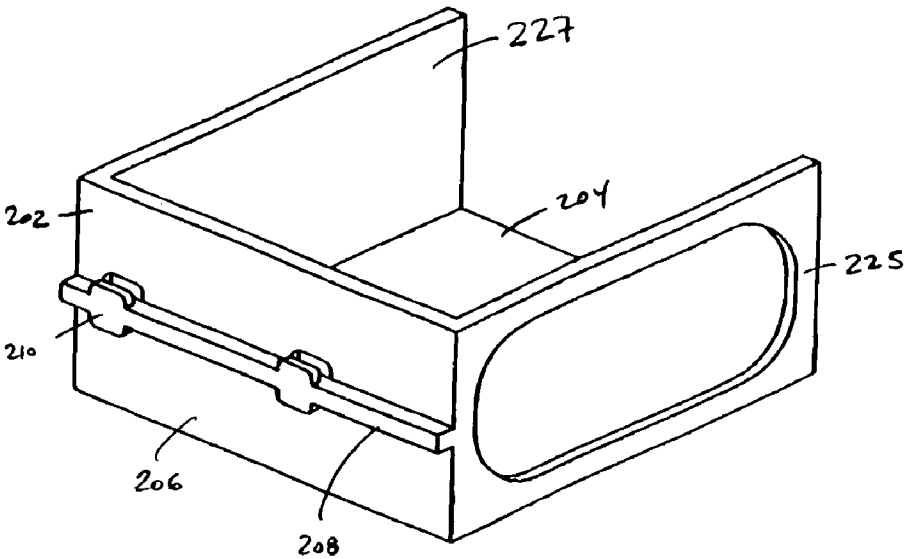
FIG. 33 illustrates another perspective view of the preformed shelf shown in FIG. 32.
Figure 32:
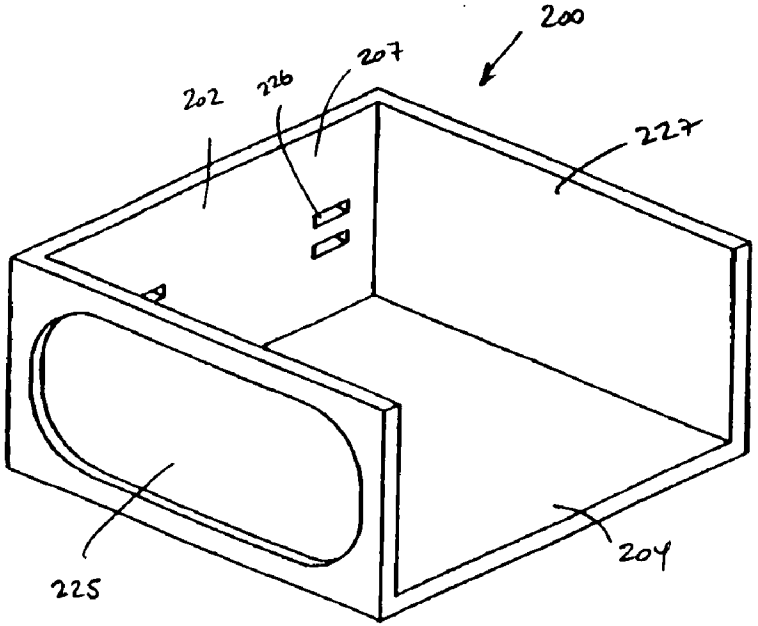
FIG. 32 depicts a perspective view of a preformed shelf in accordance with another embodiment of the present invention.

Another embodiment of the preformed shelf of the present invention is shown in FIGS. 32 and 33. This embodiment contains many aspects which are similar to the previous embodiments. Like the embodiment shown in FIGS. 28–31, the preformed shelf 200 of FIGS. 32 and 33 includes a shelf member 204 and a back member 202. The shelf member 204 generally extends from the front surface 207 of the back member 202 at a right angle. On the rear surface 206 (FIG. 33) of the back member 202 is a rail 208. Unlike the previous embodiments, two side members 225, 227 are attached to the back member 202 and the shelf member 204, to partially enclose the shelf 200.

As most clearly shown in FIG. 33, the preformed shelf 200 of this embodiment includes a rail 208 with shaped pieces 210 along the rear surface 206 of the back member 202. The rail 208 and shaped pieces 210 may be inserted into a slatted wall panel 2 using the plug and slide technique previously discussed or by inserting the rail 208 and shaped piece 210 at the side 6, 8 of a slatted wall panel 2. If the plug and slide technique is utilized, it will be advantageous for the preformed shelf 200 to include apertures 226 through the back member 202 to permit visual orientation of the alignment of the shaped pieces 210 of the preformed shelf 200 with the shaped openings 16 of the slatted wall panel 2, as previously discussed.

It will be appreciated that the preformed shelf shown in FIGS. 32 and 33 may be installed either in the orientation shown or flipped 180°. If so flipped, two such preformed shelves 200 may be stacked, one in the traditional orientation and one in the flipped orientation such that a square cubbyhole is created.

Figure 34:
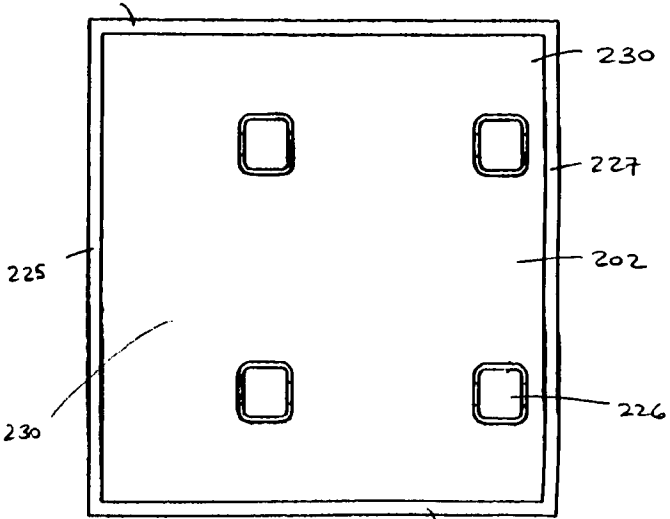
FIG. 34 depicts a front elevational view of a preformed "cubbie" in accordance with one embodiment of the present invention.
Figure 35:
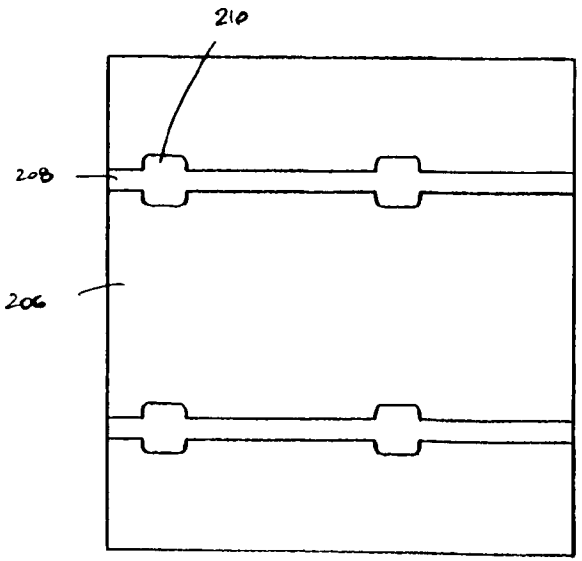
FIG. 35 depicts a rear plan view of the preformed cubbie shown in FIG. 34.

Preformed five-sided cubbies 230 may also be provided. FIG. 34 depicts a frontal plan view of a preformed cubby 230. As shown in FIG. 34, the preformed cubby 230 is substantially similar to the preformed shelf 200 shown in FIGS. 32 and 33. In this regard, the preformed cubby 230 includes a back member 202 with a shelf member 204 and two side members 225, 227 extending perpendicular therefrom. In addition, however, the preformed cubby also includes a roof member 228. It will be appreciated this leaves an open area 230 therebetween. Doors or retaining rails may be added to the open area 230 for functional or decorative purposes. As shown in FIG. 35, the rear surface 206 of the back member 202 includes a pair of rails 208 with shaped pieces 210. The rails 208 and shaped pieces 210 are designed to engage the shaped openings 16 and the recessed slots 14 of a slatted wall panel 2. The method of attaching the preformed cubby 230 is substantially similar to the method of attaching the preformed shelves as previously discussed, including the use of apertures 226 (FIG. 34) if so provided. It will be appreciated that cubbies with partially open back members may also be provided (not shown).

It will also be appreciated that the mounting systems used in the embodiments of the present invention can be interchangeable. For example, a cubby 230 may be provided with a first rail 208 and second rail 212, as shown with regard to shelf member 200 in FIG. 28.

Figure 36:
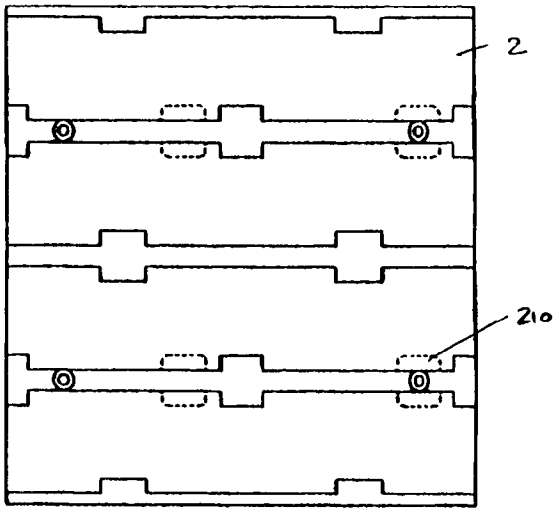
FIG. 36 depicts a frontal plan view of the method of mounting a preformed cubbie as shown in FIGS. 34 and 35.

As previously noted, the preformed shelves and preformed cubbies of the present invention each include shaped pieces 210 on their rear surfaces 206. It will be appreciated that each of the shaped pieces has been shown in an orientation which is not centered on the rear surface 206 of the preformed shelf 200 or preformed cubbie 230. Although they may be centered, it is preferential for them to be formed offset to one side so as to provide a more aesthetically pleasing installation. For example, when a preformed cubbie such as that shown in FIG. 34 is installed on a slatted wall panel such as the one shown in FIG. 6, it may be centered on the slatted wall panel 2 while not being in registration with the shaped openings 16. This creates an aesthetically pleasing display because the portions of the slatted wall panel 2 visible around the preformed cubbie 230 will be substantially even. This also enables sequential preformed cubbies 230 to be installed such that they are in communication with the previously installed preformed cubbies. FIG. 36 depicts a slatted wall panel 2 with shaped pieces 210 shown in phantom to represent one possible mounting position.

Figure 39:
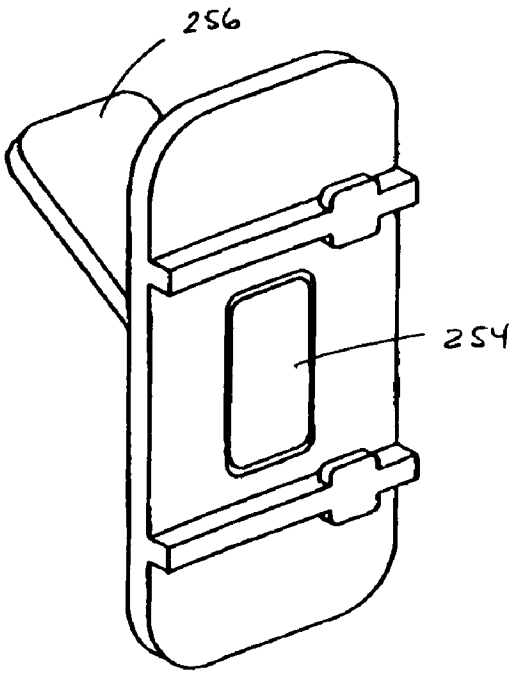
FIG. 39 depicts a rear perspective view of a modular accessory including a plug in module.
Figure 38:
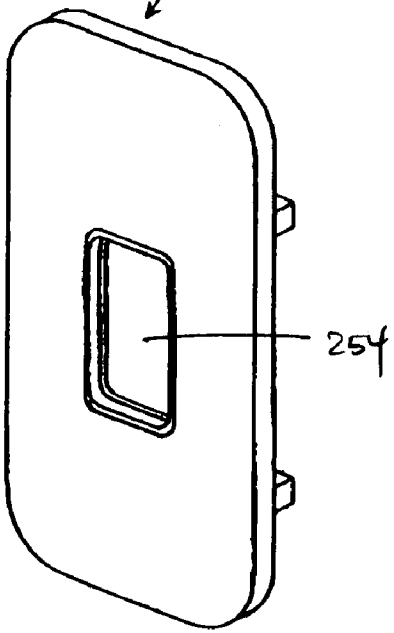
FIG. 38 illustrates a frontal perspective view of the modular accessory shown in FIG. 37.
Figure 37:
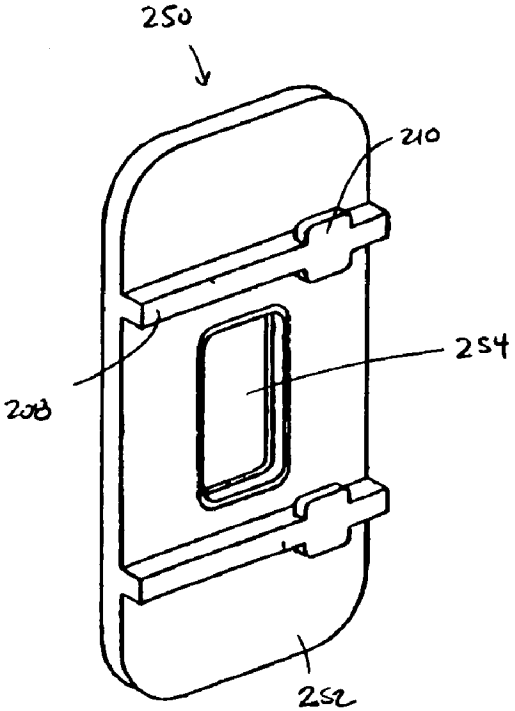
FIG. 37 depicts a rear perspective view of a modular accessory in accordance with one embodiment of the present invention.
Figure 42:
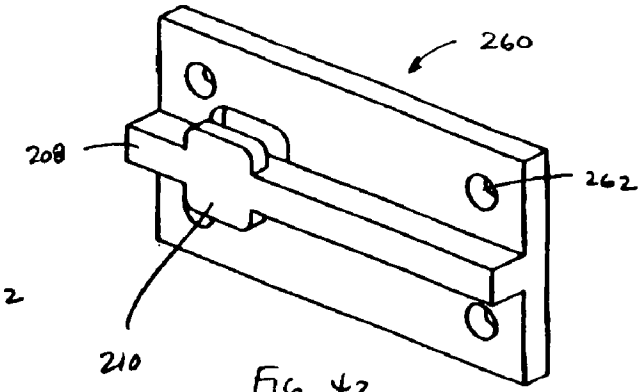
FIG. 42 depicts plug and slide hardware in accordance with a third embodiment of the present invention.
Figure 40:
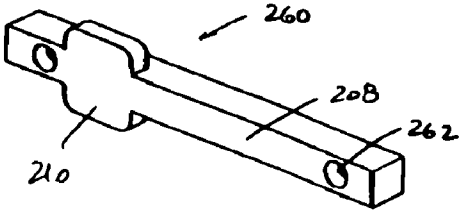
FIG. 40 depicts a perspective view of plug and slide hardware in accordance with one embodiment of the present invention.
Figure 43:
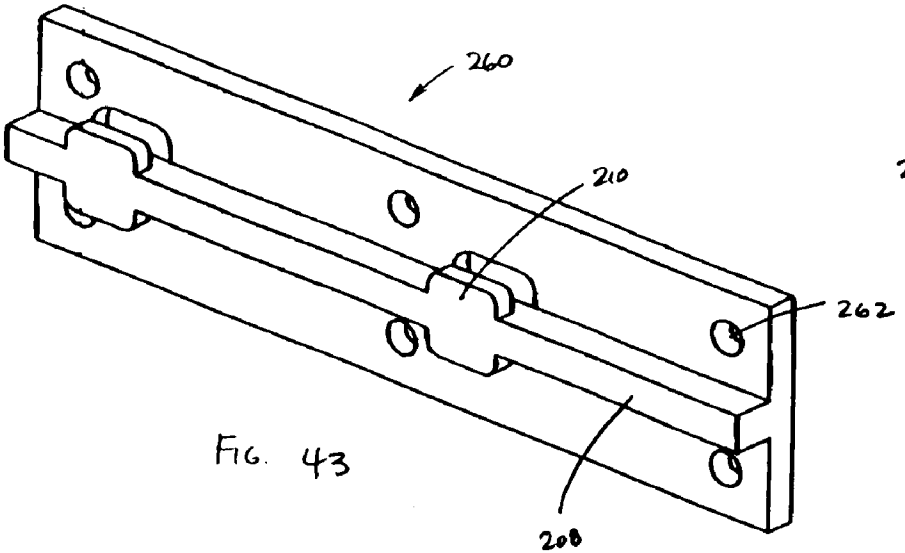
FIG. 43 depicts plug and slide hardware in accordance with a fourth embodiment of the present invention.
Figure 41:
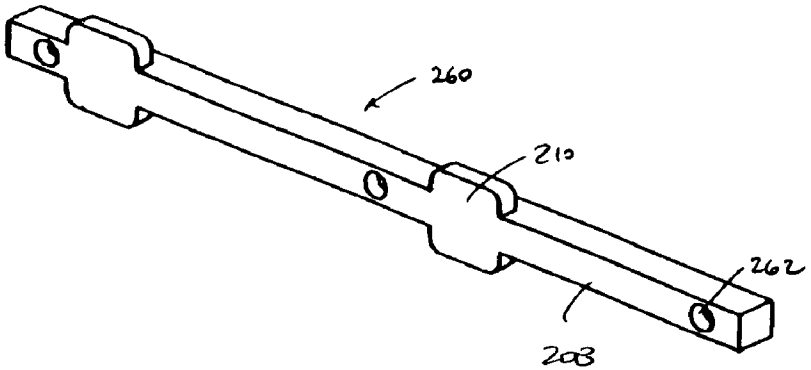
FIG. 41 depicts plug and slide hardware in accordance with a second embodiment of the present invention.

FIG. 37 depicts still another accessory for use with the slatted wall panel of the present invention. The view shown in FIG. 37 is a rear view of this modular accessory 250. FIG. 38 depicts a front view of this accessory 250. It will be noted that the accessory 250 includes a pair of rails 208 with shaped pieces 210 in order to take advantage of the plug and slide feature of the slatted wall panel 2. The rails 208 are attached to a multi-use back plate 252. The multi-use back plate 252 includes a snap-in aperture 254. It is intended that the snap-in aperture 254 receive a variety of plug-in modules 256 (FIG. 39). Such modules 256 may be permanently affixed during the manufacturing process to save on tooling costs of the overall system. For example, only one style of backplate 252 needs to be provided. This backplate 252 may then serve as the foundation for a variety of plug-in modules 256. One such plug-in module 256 includes a tongue 258 for hanging shoes (not shown) as in that shown in FIG. 39. Of course, the modules 256 may also not be permanently affixed, such that the user may swap modules from time to time. In which case, it is advantageous that the modules 256 fit within the snap-in apertures 254 in a relatively tight and secure manner, while still being releasable.

FIGS. 40–43 depict various perspective views of plug and slide hardware 260 in accordance with another embodiment of the present invention. This plug and slide hardware 260 is intended to be sold as a separate product for either original equipment manufacturers (OEM) or consumer use. Such hardware 260 will permit consumers or OEM to attach their goods to slatted wall panels 2 of the present invention. For example, a homeowner may have a particular photograph frame (not shown) which she may wish to install on a slatted wall panel 2. One of the plug and slide hardware modules 260 shown in FIGS. 40–43 may be utilized for such a purpose. The hardware 260 may be affixed to the back portion of the frame by either mechanical means, such as a mechanical fastener, or by chemical adhesives such as poster tape. Once the hardware 260 is installed, the frame may be placed in the slatted wall panel 2 using the plug and slide technique or by sliding the hardware into the side 6, 8 of a slatted wall panel 2. It will be appreciated that the hardware 260 may be provided with rails 208 and shaped pieces 210 for this purpose. The hardware 260 may also provide apertures 262 to allow for mechanical installation. Although shown with either one or two shaped pieces 221 on a single rail 208, the hardware 260 may be provided with additional rails or shaped pieces to suite the installation requirements.

The accessories described above and shown in the drawings are merely illustrative. Accessories contemplated include any accessory suitable for connection to a panel. Examples include bathroom accessories such as cup holders, soap holders, shampoo holders, conditioner holders, washrag holders, shaving cream holders, razor holders, bath oil holder, toothbrush holders, and toilet paper holders; household accessories such as key holders, photograph holders, cat walks, plant holders, and compact disc holders; office accessories such as drafting supply holders, file holders, pen containers, paper clip containers, and telephone mounts; bedroom accessories such as shoe holders, tie holders, and sock holders; kitchen accessories such as spice racks, utensil holders, and potholders; children's room accessories such as book holders, model airplane hangers, model boat hangers, and mobile hangers; industrial accessories such as tool holders, machinery manual holders, and sign or display holders; as well as for numerous additional accessories generally utilized in and around commercial or residential establishments.

Although the invention herein has been described with reference to particular embodiments, it is to be understood that these embodiments are merely illustrative of the principals and applications of the present invention. It is therefore understood that numerous modifications may be made, and are encouraged to be made, to the illustrative embodiments, and that other arrangements may be devised, without departing from the spirit and scope of the present invention.

What is claimed is:

1. A wall panel for holding an accessory comprising:

a front surface adapted to receive a shaped attachment member of an accessory so that at least a portion of the accessory is adapted to extend outwardly from the front surface;

a recessed slot formed in said front surface, at least a portion of which has an undercut; and a shaped opening in communication with a portion of said recessed slot and said undercut whereby the shaped opening lies within the front surface;

wherein said shaped opening is capable of receiving a shaped attachment member of an accessory, the shaped attachment member then being slidable within said along undercut and said recessed slot beyond the lateral limits of said shaped opening.

2. The wall panel of claim 1, further comprising slats adjacent to said recessed slot, wherein said shaped opening extends into at least one of said slats.

3. The wall panel of claim 1, further comprising:

a first side edge and an opposed second side edge; and a first end edge and an opposed second end edge extending between said first side edge and said second side edge;

wherein said recessed slot is in communication with said first end edge.

4. The wall panel of claim 1, further comprising:

a first side edge and an opposed second side edge; and a first end edge and an opposed second end edge extending between said first side edge and said second side edge;

wherein said shaped opening is in communication with said first side edge or said first end edge.

5. The wall panel of claim 1, further comprising:

a first side edge and an opposed second side edge; and a first end edge and an opposed second end edge extending between said first side edge and said second side edge;

wherein said shaped opening is in communication with both of said first end edge and said first side edge.

6. The wall panel of claim 1, further comprising:

a first side edge and an opposed second side edge; and a first end edge and an opposed second end edge extending between said first side edge and said second side edge;

wherein said shaped opening is interior of said edges and whereby the shaped attachment member of an accessory is detachable from said wall panel when aligned with said shaped opening.

7. The wall panel of claim 6, further comprising a shaped opening in communication with said first end edge.

8. The wall panel of claim 6, further comprising a shaped opening in communication with said first end edge and said first side edge.

9. The wall panel of claim 1, further comprising:

a first side edge and an opposed second side edge;

a first end edge of an opposed second end edge extending between said first side edge and said second side edge; and a female recess along one of said first end edge, said second end edge, said first side edge or said second side edge.

10. The wall panel of claim 1, further comprising:

a first side edge and an opposed second side edge;

a first end edge of an opposed second end edge extending between said first side edge and said second side edge; and at least one male protrusion extending from one of said first end edge, said second end edge, said first side edge or said second side edge.

11. The wall panel of claim 1, wherein said shaped opening is substantially round.

12. The wall panel of claim 1, wherein said panel is mounted in a vertical orientation and said shaped opening is substantially square.

13. The wall panel of claim 1, wherein said shaped opening is a logo, design, symbol or device that is associated with a company, individual or group.

14. The wall panel of claim 1, wherein said panel is mounted on a ceiling.

15. The wall panel of claim 1, wherein said recessed slot is adapted to accept a rail of said accessory.

16. The wall panel of claim 15, wherein said shaped attachment member is adapted to communicate with said rail.

17. The wall panel of claim 1, wherein said wall panel further comprises a substantially flat front face, the shaped attachment member being insertable into said shaped opening from an orientation perpendicular to said substantially flat front face.

18. A wall panel for holding an accessory comprising:

a relatively flat front surface;

a rear surface adapted to be mounted against a fixed object;

a recessed slot formed within said front surface, at least a portion of said recessed slot having an undercut;

a shaped opening formed within said front surface in communication with a portion of said recessed slot and said undercut, such that said recessed slot extends beyond said shaped opening;

wherein said shaped opening is capable of receiving a shaped attachment member of an accessory so that at least a portion of the accessory is adapted to extend outwardly from the front surface, the shaped attachment member then being slidable within said undercut and along said recessed slot beyond the lateral limits of said shaped opening.

19. A wall panel for holding an accessory comprising:

a recessed slot, at least a portion of which has an undercut;

a shaped opening in communication with a portion of said recessed slot and said undercut;

a first side edge and an opposed second side edge; and a first end edge and an opposed second end edge extending between said first side edge and said second side edge;

wherein said shaped opening is in communication with both of said first end edge and said first side edge and is capable of receiving a shaped attachment member of an accessory, the shaped attachment member then being slidable within said undercut and said recessed slot beyond the limits of said shaped opening.

20. A wall panel for holding an accessory comprising:

a recessed slot, at least a portion of which has an undercut; and a first side edge and an opposed second side edge;

a first end edge and an opposed second end edge extending between said first side edge and said second side edge;

a shaped opening in communication with a portion of said recessed slot and said undercut, said shaped opening capable of receiving a shaped attachment member of an accessory, the shaped attachment member then being slidable within said undercut and said recessed slot beyond the limits of said shaped opening, said shaped opening being interior of said edges whereby the shaped attachment member of an accessory is detachable from said wall panel when aligned with said shaped opening;

a shaped opening in communication with said first end edge and said first side edge.

21. A wall panel system comprising a plurality of wall panels, each of said panels comprising:

a front surface adapted to receive a shaped attachment member of an accessory so that at least a portion of the accessory is adapted to extend outwardly from the front surface;

a recessed slot formed in said front surface, at least a portion of which has an undercut; and a shaped opening in communication with a portion of said recessed slot and said undercut whereby the shaped opening lies within the front surface;

wherein said shaped opening is capable of receiving a shaped attachment member of an accessory, the shaped attachment member then being slidable within said undercut and along said recessed slot beyond the lateral limits of said shaped opening.

* * * * *

UNITED STATES PATENT AND TRADEMARK OFFICE

CERTIFICATE OF CORRECTION

PATENT NO. : 6,945,414 B1 
DATED : September 20, 2005
INVENTOR(S) : Kenneth V. Stevens and Constantine A. Valaoritis It is certified that error appears in the above-identified patent and that said Letters Patent is hereby corrected as shown below:

Title page,
Item [75], Inventors, delete "Keith E. Gilman".

Column 25,
Line 39, delete "along" before "undercut." and insert -- along -- after "and".

Signed and Sealed this

Twenty-seventh Day of December, 2005

JON W. DUDAS
*Director of the United States Patent and Trademark Office*